US005451039A

United States Patent [19]

Adachi

[11] Patent Number: 5,451,039

[45] Date of Patent: Sep. 19, 1995

[54] CUT SHEET FEEDER FOR IMAGE FORMING APPARATUS

[75] Inventor: Kosai Adachi, Tsukuba, Japan

[73] Assignee: Riso Kagaku Corporation, Tokyo, Japan

[21] Appl. No.: 213,007

[22] Filed: Mar. 15, 1994

[30] Foreign Application Priority Data

Mar. 16, 1993 [JP] Japan ..... 5-056033

[51] Int. Cl.[6] ..... B65H 3/44

[52] U.S. Cl. ..... 271/9.06; 271/147; 271/152

[58] Field of Search ..... 271/9, 157, 158, 152, 271/147, 162

[56] References Cited

U.S. PATENT DOCUMENTS 4,332,375 6/1982 Tsubo ..... 271/9
5,335,901 8/1994 Nonomura et al. ..... 271/157 X

FOREIGN PATENT DOCUMENTS 117722 1/1989 Japan ..... 271/157
122733 1/1989 Japan ..... 271/157

*Primary Examiner*—David H. Bollinger

*Attorney, Agent, or Firm*—Kanesaka & Takeuchi

[57] ABSTRACT

A cut sheet feeder for use with an image forming apparatus, comprising: a sheet feed mechanism for picking up stacked cut sheets one at a time from a single sheet feed position and for feeding each sheet to an image recording portion; a sheet feed unit which is vertically movable relative to the sheet feed mechanism, to which a cassette containing cut sheets may be attached in a detachable manner, and which has a cutout portion corresponding to the position of the sheet feed mechanism; a sheet feed table which is vertically movable within the sheet feed unit and which carries a large number of cut sheets; and a sheet feed controller for lifting, in a sheet feed mode based on the cassette, at least the sheet feed unit up to a position where the cut sheets in the cassette reach the sheet feed position; and for lifting, in a sheet feed mode based on the sheet feed table, the sheet feed unit to a position where the top of the unit comes above the sheet feed position with the cutout portion of the unit letting the sheet feed mechanism pass therethrough unchecked, thereby lifting the sheet feed table up to a position where the cut sheets on the sheet feed table reach the sheet feed position.

6 Claims, 19 Drawing Sheets

Ⓔ (TO STEP 12-10)

CUT SHEET FEEDER FOR IMAGE FORMING APPARATUS

BACKGROUND OF THE INVENTION

1. Field of the Invention

The present invention relates to a cut sheet feeder for use with the image forming apparatus such as a copier or a printer, the feeder feeding the apparatus with cut sheets of recording paper.

2. Description of the Related Art

The image forming apparatus is most often used to record images on a large number of cut sheets of the same size which are fed continuously. But occasionally, it is desired to interrupt the ongoing process of image printing involving many cut sheets so as to insert image printing of a different kind typically on a smaller number of sheets. Some of the conventional cut sheet feeders for use with the image forming apparatus have mechanisms that meet the requirements for the on-demand inserted printing.

Such conventional cut sheet feeders have a plurality of sheet feed mechanisms positioned near the sheet feed table or sheet cassette assembly, each mechanism comprising its dedicated pick-up rollers, guide plates and other related parts. When the operator selects a desired sheet type, the corresponding sheet feed mechanism is activated. The activated mechanism picks up cut sheets one by one from the applicable sheet feed table or from the corresponding sheet cassette and feeds them into position inside the image forming apparatus.

The conventional cut sheet feeder of the above-mentioned type has as many sheet feed mechanisms as the number of the sheet feed tables or the sheet cassettes that are mounted in advance of feed operation. The cut sheet feeder also has a plurality of sheet transport routes for guiding cut sheets from the multiple storage locations via rollers to a common feed position. These features combine to make the cut sheet feeder bulky, complex, and thus prone to feed-related troubles.

In view of these drawbacks of the prior art, the inventor of this invention came up with a cut sheet feeder having a single sheet feed mechanism to which any one of a plurality of sheet feed tables carrying many cut sheets or of sheet cassettes containing different sizes of cut sheets is positioned as desired.

But because the cut sheet feeder of the above type requires one of its sheet feed tables or sheet cassettes to be moved to a single sheet feed position, arrangements need to be made so that one table or cassette will not interfere during movement with any other table or cassette. In addition, this cut sheet feeder needs to be constructed so that cut sheets on the sheet feed table or in the sheet cassette selected will be fed quickly, simply and smoothly to the sheet feed mechanism with the aid of appropriate electrical control means.

With the sheet cassettes made detachable, the procedure of on-demand inserted printing is made simpler, but there are still measures to be taken to ensure that the operator carries out operations correctly and that the whole system runs with safety and without malfunction.

SUMMARY OF THE INVENTION

It is therefore an object of the present invention to provide a small, simply structured cut sheet feeder for use with an image forming apparatus, the feeder having a sheet feed unit and a sheet feed table lifted up to the sheet feed position of a single sheet feed mechanism for selective switching between the sheet cassette-based and the sheet feed table-based feed operation.

In carrying out the invention and according to one first aspect thereof, there is provided a cut sheet feeder for use with an image forming apparatus, comprising: a sheet feed mechanism 3 (see the accompanying drawings for reference numerals) for picking up stacked cut sheets 68 or 69 one at a time from a single sheet feed position P2 and for feeding each sheet to an image recording portion; a sheet feed unit 10 which is vertically movable relative to the sheet feed mechanism 3, to which a cassette K containing cut sheets 69 may be attached in a detachable manner, and which has a cutout portion 14 corresponding to the position of the sheet feed mechanism; a sheet feed table 50 which is vertically movable within the sheet feed unit 10 and which carries a large number of cut sheets 68; and sheet feed control means 100 for lifting, in a sheet feed mode based on the cassette K, at least the sheet feed unit 10 up to a position where the cut sheets 69 in the cassette K reach the sheet feed position P2; and for lifting, in a sheet feed mode based on the sheet feed table 50, the sheet feed unit 10 to a position where the top of the sheet feed unit 10 comes above the sheet feed position P2 with the cutout portion 14 letting the sheet feed mechanism 3 pass therethrough unchecked, thereby lifting the sheet feed table 50 up to a position where the cut sheets 68 on the sheet feed table 50 reach the sheet feed position P2.

According to another aspect of the invention, there is provided a cut sheet feeder for use with an image forming apparatus, comprising: a sheet feed mechanism 3 for picking up stacked cut sheets 68 or 69 one at a time from a single sheet feed position P2 and for feeding each sheet to an image recording portion; a sheet feed unit 10 which is vertically movable relative to the sheet feed mechanism 3, to which a cassette K containing cut sheets 69 may be attached in a detachable manner, and which has a cutout portion 14 corresponding to the position of the sheet feed mechanism 3; and a sheet feed table 50 which is vertically movable within the sheet feed unit 10 and which carries a large number of cut sheets; wherein the sheet feed unit 10 and the sheet feed table 50 are connected respectively to two clutches **9*a* and 9*b* engaged with a motor 8 acting as a driving source so that the sheet feed unit 10 and the sheet feed table 50 are vertically moved either singly or in combination depending on the switching of the clutches 9*a* and 9*b*; the sheet feed unit 10 and the sheet feed table 50 being moved in combination when the two clutches 9*a* and 9*b* are both engaged with the motor 8 whereas if only one of the two clutches 9*a* and 9*b* is engaged with the motor 8, either the sheet feed unit 10 or the sheet feed table 50** connected to the engaged clutch is moved vertically.

In a preferred structure according to the invention, the sheet feed unit 10 and the sheet feed table 50 are connected respectively to two clutches **9*a* and 9*b* engaged with a motor 8 acting as a driving source, and the sheet feed control means 100 controls the switching of the two clutches 9*a* and 9*b* so that the sheet feed unit 10 and the sheet feed table 50** are vertically moved either singly or in combination.

In a further preferred structure according to the invention, the cut sheet feeder further comprises a sheet feed upper limit sensor 111 and cassette presence detection means 114 and **100*a*. With this structure, the sheet feed upper limit sensor 111 detects whether the cut sheets 68 or 69 either in the sheet feed unit 10 or on the sheet feed table 50 are set to the sheet feed position P2 and outputs a detection signal accordingly. The cassette presence detection means 114 and 100***a* detects the presence and absence of a cassette K on the sheet feed unit 10 and outputs a detection signal indicating either the presence or the absence of the cassette K. The sheet feed control means 100 verifies whether the sheet feed mode based on the cassette K or the sheet feed mode based on the sheet feed table 50 is in effect in accordance with the detection signal from the cassette presence detection means 114 and 100*a*, and lifts either the sheet feed unit 10 or the sheet feed table 50 up to the sheet feed position P2 on the basis of the detection signal from the sheet feed upper limit sensor 111.

In a yet further preferred structure according to the invention, the cassette presence detection means 114 and 100*a* are composed of a sheet size indication member and sheet size output means. The sheet size indication member is attached to the cassette K to indicate the size of the cut sheets 69 contained therein. The sheet size output means is attached to the sheet feed unit 10 to output a sheet size signal upon detecting size indication data coming from the sheet size indication member of the cassette K.

In another preferred structure according to the invention, the sheet size indication member is a magnet attached to a different position of the cassette K depending on the size of cut sheets 69 contained therein, and the sheet size output means is a reed switch corresponding locationally to the magnet of the cassette K and outputting a detection signal reflecting the size of the cut sheets 69 in the cassette K.

The invention when embodied works as follows: when the cassette K is mounted on the sheet feed unit 10 for the cassette-based sheet feed operation, the sheet feed control means 100 lifts at least the sheet feed unit 10 until the cut sheets 69 in the cassette K reach the sheet feed position P2. With the cut sheets 69 set to the sheet feed position P2, the sheet feed mechanism 3 feeds the sheets one by one from the cassette K into the image forming apparatus.

When the cassette K is removed from the sheet feed unit 10 for the sheet feed table-based feed operation, the sheet feed control means 100 lifts the sheet feed unit 10 until the top of the sheet feed unit 10 comes above the sheet feed position P2, thereby lifting the sheet feed table 50 up to a position where the cut sheets 68 on the sheet feed table 50 reach the sheet feed position P2.

While the sheet feed unit 10 is being lifted, the sheet feed mechanism passes through the cutout portion 14 without interference with the unit 10. In this manner, the cut sheets 68 on the sheet feed table 50 are fed into the image forming apparatus by the sheet feed mechanism 3.

Other objects, features and advantages of the present invention will become apparent in the following specification and accompanying drawings.

BRIEF DESCRIPTION OF THE DRAWINGS

FIG. 6(*b*) is a view of the sheet feed status of the cut sheet feeder in the cassette feed mode;

FIG. 11(*b*) is view of the status of the cut sheet feeder in the cassette feed mode prior to actual sheet feed;

DESCRIPTION OF THE PREFERRED EMBODIMENT

Figure 1:
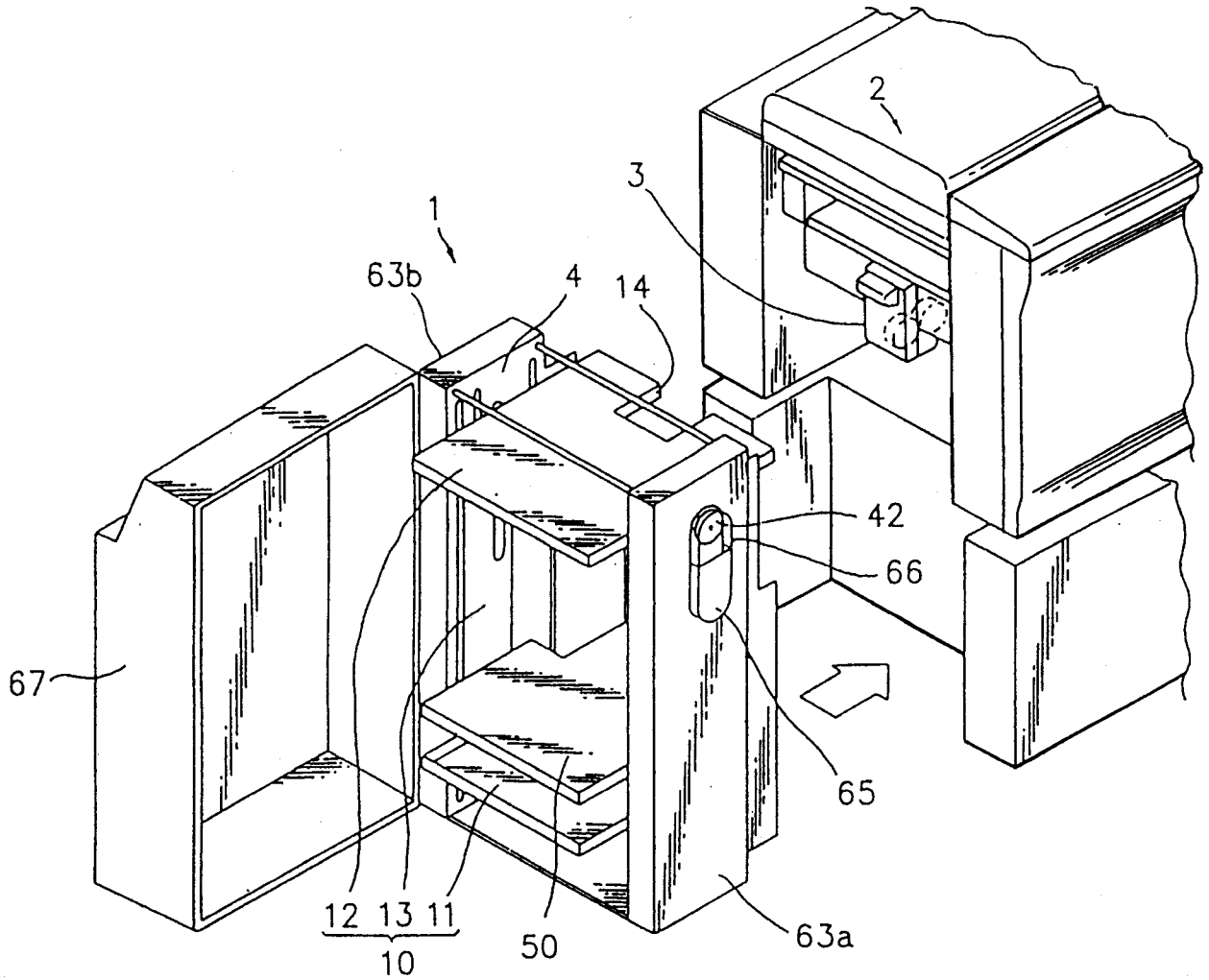
FIG. 1 is a perspective view of a cut sheet feeder embodying the invention and for use with a printer.

A cut sheet feeder 1 shown in FIG. 1 is one preferred embodiment of the invention incorporated in a mimeograph printing machine 2. A sheet feed mechanism 3 furnished on the side of the printing machine 2 includes pick-up rollers 43 for taking in cut sheets from the cut sheet feeder 1. The cut sheet feeder 1 positions to the sheet feed mechanism 3 either a cassette containing cut sheets or a sheet feed table carrying cut sheets stacked thereon. The cassette or the sheet feed table is moved up and down before coming into position to feed the printing machine 2 with necessary cut sheets.

Figure 2:
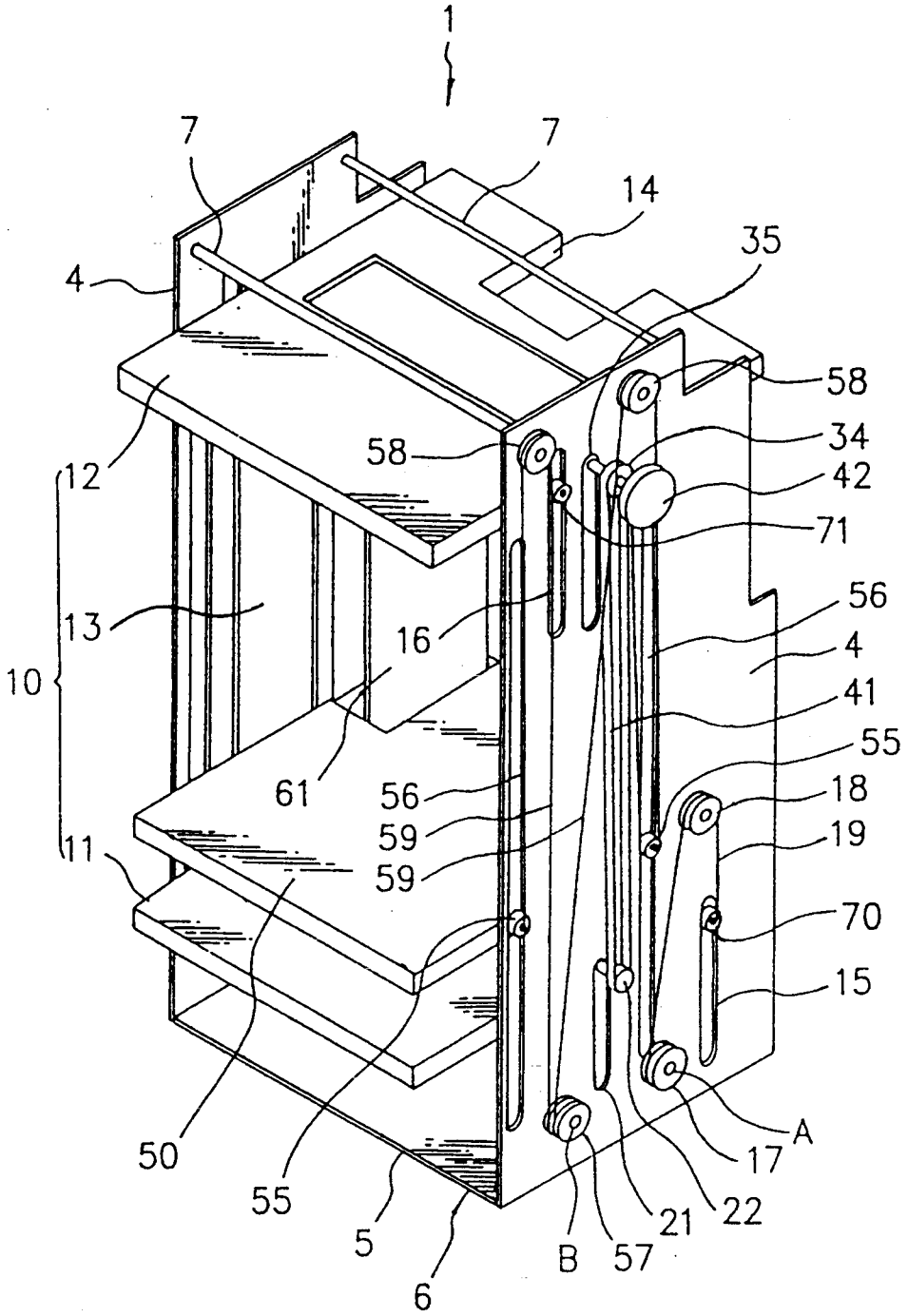
FIG. 2 is a perspective view showing major driving mechanisms of the cut sheet feeder.
Figure 3:
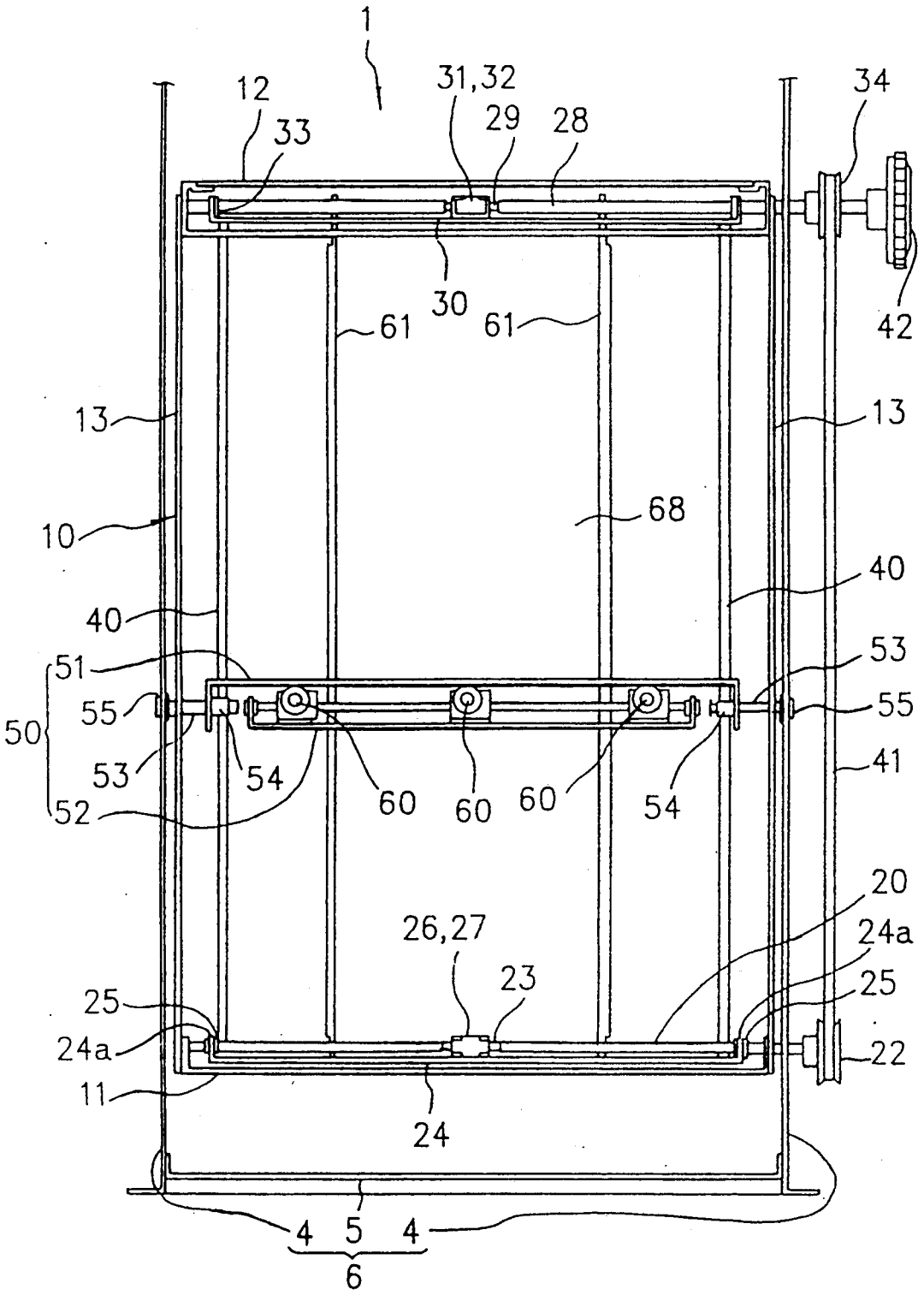
FIG. 3 is a front view indicating key structures of the cut sheet feeder.

As shown in FIGS. 2 and 3, the cut sheet feeder 1 has a substantially box-like frame 6 comprising a right- and a left-hand side plate 4 and a bottom plate 5. The top portions of the side plates 4 and 4 are interconnected fixedly by use of bars 7.

Figure 4:
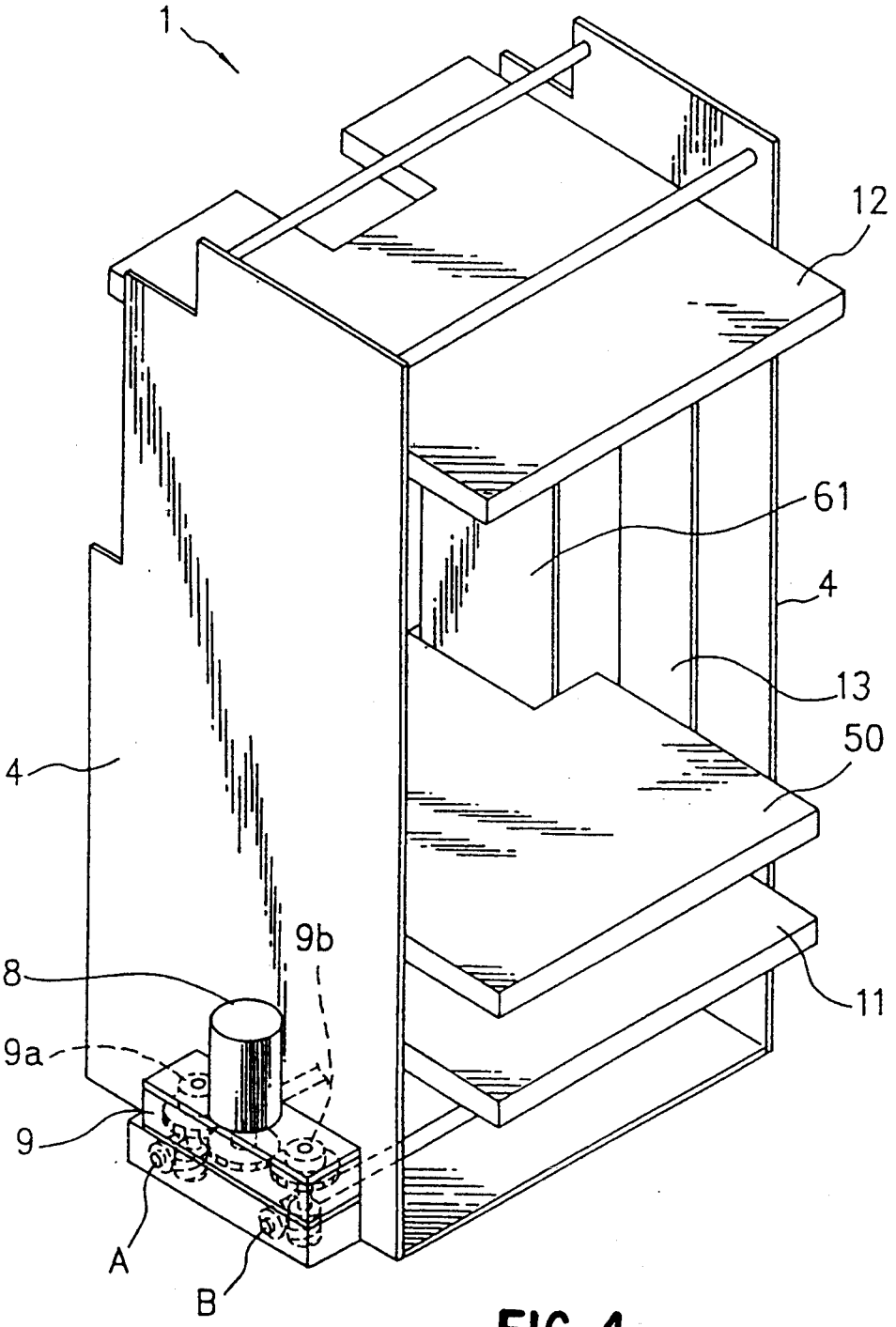
FIG. 4 is a perspective view illustrating the driving source and related parts of the cut sheet feeder.

As depicted in FIG. 4, one side plate 4 has a motor 8 mounted on its outer surface near the bottom, the motor acting as a driving source of the cut sheet feeder 1. The motor 8 is coupled to the input shaft of a gear box 9. The gear box 9 comprises reduction gears that transmit the torque of the motor 8 to two clutches 9*a* and 9*b*. The clutches 9*a* and 9*b* are coupled respectively to two drive shafts A and B. The drive shafts A and B are in parallel and set apart from each other by a predetermined distance. The shafts A and B are furnished rotatably across the two side plates 4.

As indicated in FIGS. 2 and 3, a substantially box-like sheet feed unit 10 is furnished in a vertically movable manner inside the frame 6. The sheet feed unit 10 has a bottom plate 11 and a top cassette plate 12, the latter plate 12 serving as a first sheet feed table. The two plates 11 and 12 are coupled by use of a pair of side plates 13. The top cassette plate 12 has a sheet-containing cassette K placed thereon (see FIG. 6(*b*)).

When a large number of cut sheets are to be printed continuously without the use of the cassette K, the cassette K is detached and the entire sheet feed unit 10 is set in an upward, appropriate position in a manner to be described later. At this point, the cassette plate 12 is kept from interfering with the pick-up rollers 43 of the sheet feed mechanism 3. The interference is avoided by furnishing the cassette plate 12 with a cutout portion 14, as indicated in FIGS. 1 and 2.

FIG. 2 shows the frame 6 having vertically parallel guide grooves 15 and 16. A roller 70 attached rotatably to one edge of the bottom plate 11 moves freely up and down along one guide groove 15. Another roller 71 attached rotatably to one edge of the cassette plate 12 moves freely up and down along the other guide groove 16.

A take-up pulley 17 is mounted on the tip of the drive shaft A protruding from the side plate 4. An intermediate pulley 18 is furnished on the side plate 4 and above the guide groove 15. One end of a wire 19 is attached to the circumference of the take-up pulley 17. The wire 19 is engaged around the intermediate pulley 18, and has its other end connected to the roller 70.

As the motor 8 drives the drive shaft A to get the take-up pulley 17 to take up the wire 19, the wire 19 pulls the roller 70 upward. This causes the sheet feed unit 10 to move up along the guide grooves 15 and 16 inside the frame 6. When the drive shaft A is rotated in reverse, the wire 19 is unwound from the take-up pulley 17 to let the sheet feed unit 10 come down by its own weight. In this manner, the box-like sheet feed unit 10 is moved up and down inside the frame 6.

As shown in FIGS. 2 through 5, an adjusting shaft 20 is provided above the bottom plate 11 of the sheet feed unit 10 and in parallel with the drive shafts A and B. The adjusting shaft 20 spans rotatably the side plates 13 of the sheet feed unit 10. One end of the adjusting shaft 20 protrudes from a groove 21 provided vertically along one side plate 4 of the frame 6. The protruding end of the adjusting shaft 20 has a pulley 22 mounted thereon. A thread portion 23 is provided in the middle of the adjusting shaft 20.

Between the bottom plate 11 and the adjusting shaft 20 of the sheet feed unit 10 is a lower fence plate 24. The adjusting shaft 20 penetrates the edges 24*a* and 24*b* of the lower fence plate 24 with slide bushes 25 interposed between the shaft and the plate edges. The thread portion 23 of the adjusting shaft 20 engages with a thread receiver 27 fixed by fittings 26 to the top of the lower fence plate 24. In this setup, rotating the adjusting shaft 20 causes the lower fence plate 24 to move axially within the sheet feed unit 10.

The above-described mechanism for moving the lower fence plate 24 has its counterpart under the cassette plate 12 of the sheet feed unit 10, as shown in FIG. 3. In the latter mechanism, a thread portion 29 of an adjusting shaft 28 engages with a thread receiver 32 fixed by fittings 31 to an upper fence plate 30. As depicted in FIG. 2, the upper adjusting shaft 28 penetrates a groove 35 provided on the side plate 4. Reference numeral 33 stands for slide bushes, and 34 for a pulley. The pulley is fixed to the adjusting shaft 28.

As shown in FIG. 3, the upper fence plate 30 and the lower fence plate 24 are coupled by use of guide shafts 40. A timing belt 41 is engaged around a pulley 34 of the upper fence plate 30 and around a pulley 22 of the lower fence plate 24. The adjusting shaft 28 of the upper fence plate 30 has a dial 42 for manual operation. The dial 42 when operated allows the adjusting shaft 28 to be rotated manually.

When the upper adjusting shaft 28 is rotated by manually turning the dial 42, the lower adjusting shaft 20 is rotated concurrently by way of the pulleys 34 and 22 and the timing belt 41. The upper and lower fence plates 30 and 24 coupled by the guide shafts 40, with their positions thus adjusted crosswise inside the sheet feed unit 10, constitute a mechanism for horizontally positioning a sheet feed table 50, to be described later with reference to FIG. 3.

As shown in FIG. 3, the sheet feed unit 10 incorporates the sheet feed table 50 under the cassette plate 12. The sheet feed table 50 is vertically movable and serves as a second sheet feed table. The sheet feed table 50 comprises an upper tray 51 on which a large number of cut sheets are stacked, and a lower tray 52 that movably supports the upper tray 51.

Guide members 54 are furnished on both sides of the upper tray 51. The guide shafts 40 penetrate the guide members 54. The upper tray 51 moves up and down along the guide shafts 40.

As shown in FIGS. 2 and 3, rollers 55 are provided at both ends of support shafts 53 fixed to the lower tray 52. As indicated in FIG. 2, the side plate 4 of the frame 6 has two vertical guide grooves 56 with which the rollers 55 of the support shafts 53 are movably engaged. A take-up pulley 57 is attached to the end of the drive shaft B protruding from the side plate 4. Intermediate pulleys 58 are provided on the side plate 4 above the guide grooves 56. One end of each of two wires 59 is attached to the circumference of the take-up pulley 57. The two wires 59 are engaged respectively around the two different intermediate pulleys 58, and have their other ends attached to the two rollers 55.

When the motor 8 drives the drive shaft B causing the take-up pulley 57 to take up the two wires 59, the wires 59 pull up the rollers 55 and thus lift the lower tray 52 along the guide shafts 40 within the sheet feed unit 10. When the drive shaft B is rotated in reverse, the wires 59 are unwound from the take-up pulley 57 to let the lower tray 52 come down by its own weight.

The side plate 4 opposite to the one shown in FIG. 2 has another identical mechanism for driving the sheet feed unit 10 and the sheet feed table 50 by use of the drive shafts A and B and of the wire and pulley arrangement. This mechanism is omitted in FIG. 4.

As shown in FIG. 3, a plurality of bearings 60 are provided on top of the lower tray 52. These bearings 60 carry the upper tray 51 in a freely movable manner. The upper tray 51 is movable vertically along the guide shafts 40 and horizontally along the support shafts 53. When the dial 42 is manipulated to move the upper and lower fence plates 30 and 24 horizontally, the upper tray 51 of the sheet feed table 50 moves along the support shafts 53.

Figure 5:
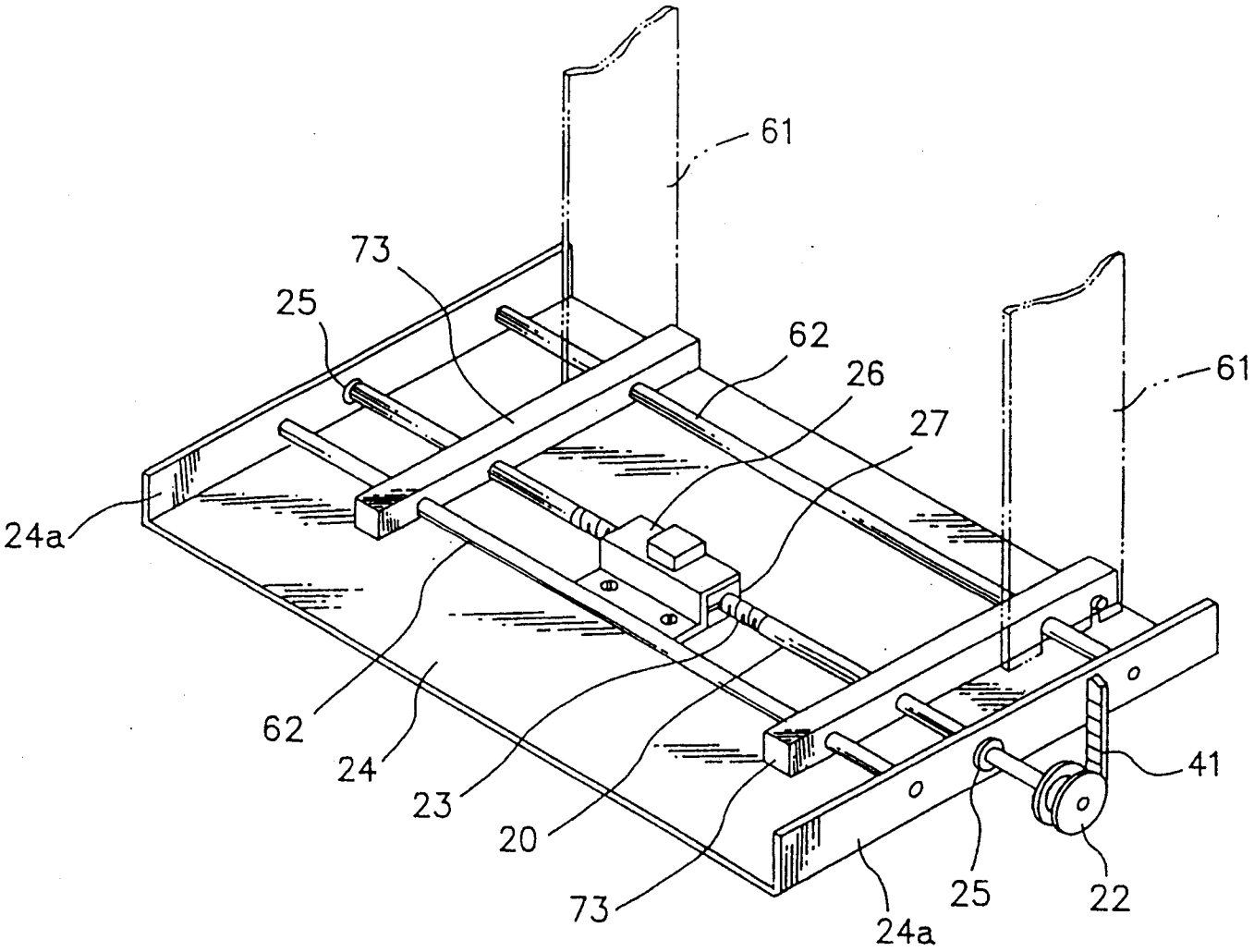
FIG. 5 is a perspective view depicting mechanisms for adjusting fences in the cut sheet feeder.

As shown in FIGS. 3 through 5, two fences 61 are furnished in a horizontally movable manner between the upper and lower fence plates 30 and 24. As depicted in FIG. 5, sliders 73 are mounted slidingly on two parallel guide shafts 62 fixed to the lower fence plate 24. The lower portions of the fences 61 are fixed to the sliders 73 so that the fences 61 may be moved together with the sliders 73 along the guide shafts 62. Although not shown, the same mechanism is provided above the upper fence plate 30 and the fences 61. Fittings, also not shown, are provided to secure the fences 61 in position.

Comparing FIG. 1 with FIG. 2 reveals that the mechanisms outside the side plates 4 are covered with outer frames 63*a* and 63*b*. At the front of the cut sheet feeder 1 is the cover 67 installed swingingly, as shown in FIG. 1. Arrangements are made so that if the cover 67 is left open, the moving parts will not be driven or moved up or down. This ensures the operator's safety upon operation.

Figure 6A:
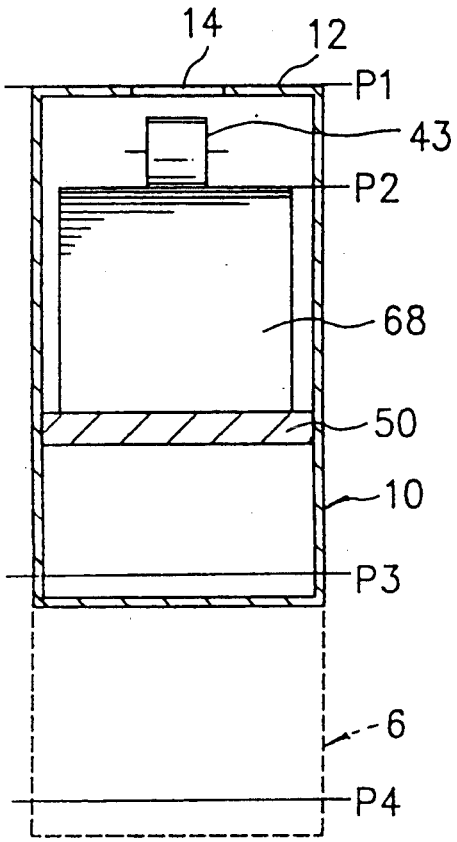
FIG. 6(*a*) is a view of the sheet feed status of the cut sheet feeder in the table feed mode.
Figure 6B:
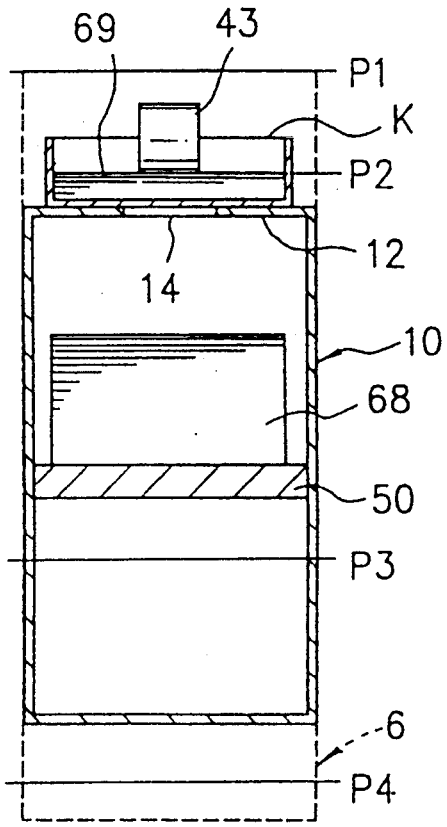

With the above setup, suppose that a large number of cut sheets are desired to be printed continuously (in the table feed mode, to be described later in more detail). In that case, without the cassette K mounted on the cassette plate 12, the sheet feed unit 10 and the sheet feed table 50 are moved up in cooperation. The cassette plate 12 is positioned above the sheet feed mechanism 3, as shown in FIG. 6(*a*). At this point, with the clutches 9*a* and 9*b* engaged, driving the motor 8 in the forward direction causes the drive shafts A and B to lift the sheet feed unit 10 and the sheet feed table 50.

While the sheet feed unit 10 and the sheet feed table 50 are being lifted, the cutout portion 14 of the cassette plate 12 allows the entire sheet feed unit 10 including the plate 12 to go up without interference with the sheet feed mechanism 3. The sheet feed unit 10 is then positioned so that the pick-up rollers 43 of the sheet feed mechanism 3 will come into contact, at a predetermined contact pressure, with the top of the cut sheets 68 stacked on the sheet feed table 50. After printing is started, the sheet feed table 50 alone goes up as the stacked cut sheets 68 are being exhausted. The sheet feed table 50 is lifted by having only the drive shaft B rotate in the forward direction with the clutch 9*b* alone engaged.

In the table feed mode, the printing position relative to the cut sheets 68 is fine-adjusted by use of the dial 42. That is, the upper and lower fence plates 30 and 24 as well as the upper tray 51 of the sheet feed table 50 are adjusted crosswise in position by manipulating the dial 42.

Suppose that cut sheets are desired to be fed from the cassette (in the cassette feed mode, to be described later in more detail). In that case, the sheet feed unit 10 and the sheet feed table 50 are moved down in cooperation, as shown in FIG. 6(*b*). The cassette plate 12 is positioned under the sheet feed mechanism 3. At this point, with the clutches 9*a* and 9*b* engaged, driving the motor 8 in reverse causes the drive shafts A and B to lower the sheet feed unit 10 and the sheet feed table 50. This time, too, the sheet feed mechanism 3 goes through the cutout portion 14 without interference with the cassette plate 12. As depicted in FIG. 6(*b*), the cassette K containing cut sheets 69 is mounted on the cassette plate 12. When a print start button 82 on the side of the printing machine 2 is pushed, the sheet feed unit 10 goes up and comes into contact, at a predetermined contact pressure, with the pick-up rollers 43. The sheet feed mechanism 3 then starts feeding the sheets.

Figure 7:
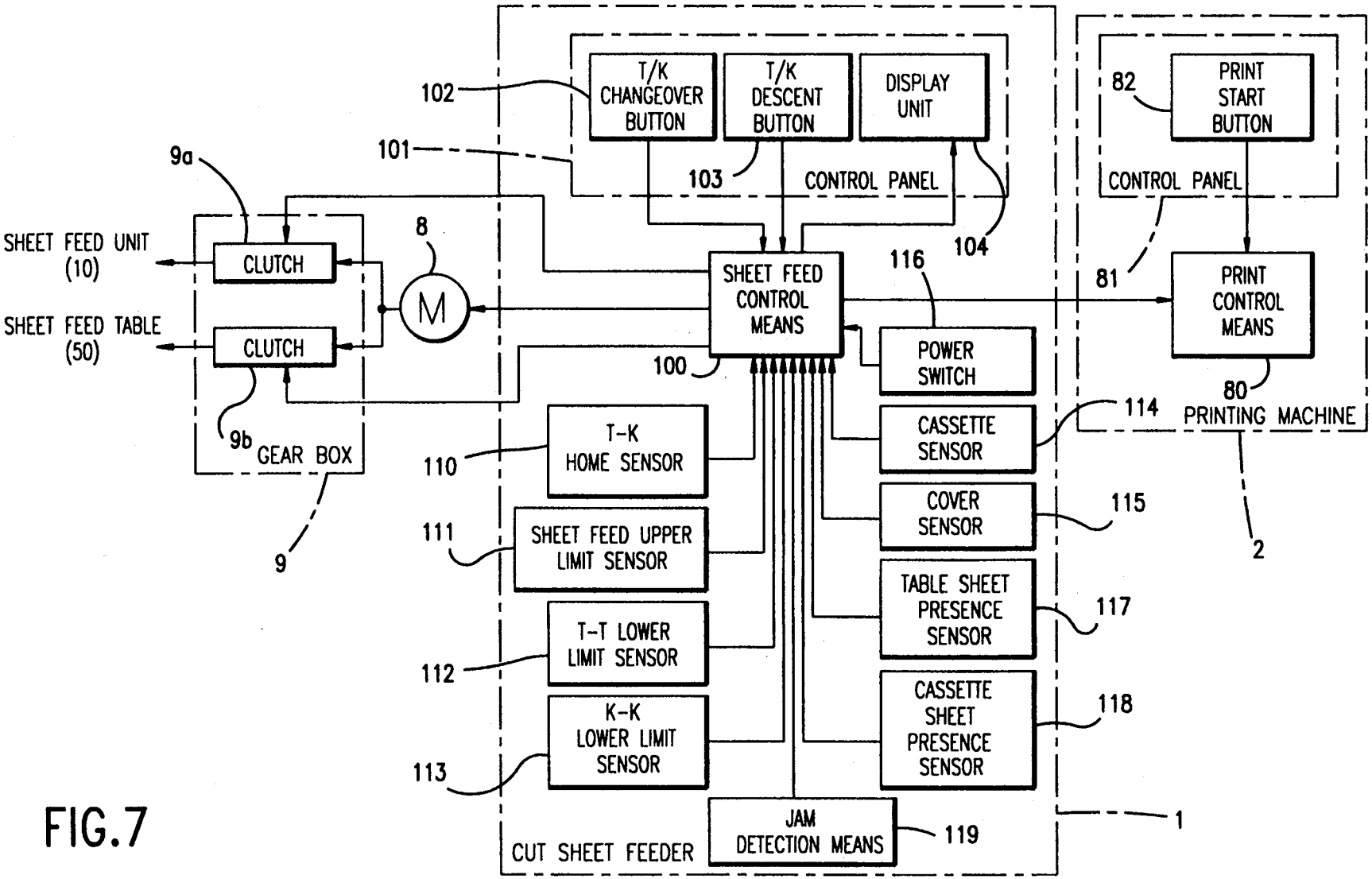
FIG. 7 is a block diagram of the electrical constitution of the cut sheet feeder.

The electrical constitution of the cut sheet feeder 1 described above will now be explained with reference to the block diagram of FIG. 7. The printing machine 2 is controlled in printing by print control means 80. The print control means 80, in turn, is set and activated by use of the print start button 82 and other controls on a control panel 81.

Sheet feed control means 100 on the side of the cut sheet feeder 1 is electrically connected to the print control means of the printing machine 2 for sheet feed control during printing. On a control panel 101 of the cut sheet feeder 1 are a table/cassette changeover button (called the T/K changeover button) 102, a table/-cassette descent button (T/K descent button) 103, and a display unit 104 acting as indication means. The sheet feed control means 100 controls the driving of the motor 8 and the engagement of the clutches 9*a* and 9*b* on the basis of an operation signal from the control panel 101 (to be described later) and of the detection signal from any of the sensors acting as detection means. The sheet feed unit 10 and the sheet feed table 50 go up and come down under control of the sheet feed control means 100.

The T/K changeover button 102 is set to one of the two modes: the table feed mode (T mode) in which a large number cut sheets 68 stacked on the sheet feed table 50 are fed and printed continuously, and the cassette feed mode (K mode) in which the cut sheets 69 in the cassette K (FIG. 6(*b*)) are fed and printed. The T/K descent button 103 is used in the T or K mode to lower either the sheet feed unit 10 or the sheet feed table for recovery from jamming or for sheet replenishment. The display unit 104 displays the operation status during sheet feed operation.

Figure 8:
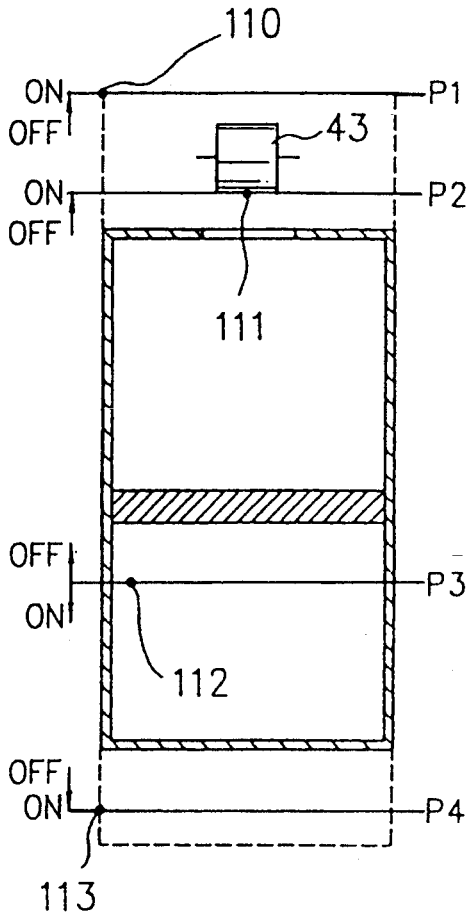
FIG. 8 is a schematic view showing sensor positions in the cut sheet feeder.

As shown in FIG. 8, various sensors for sending detection signals to the sheet feed control means 100 are located fixedly where appropriate such as on the side plates 4 in the vertical direction of the sheet feed unit 10. A T-K home sensor 110 is positioned at the highest stop position of the sheet feed unit 10. The sensor 110 outputs an ON signal only when the cassette table 12 of the sheet feed unit 10 is in a T-K home position P1; otherwise the sensor 110 outputs an OFF signal.

A sheet feed upper limit sensor 111 is attached to the pick-up rollers 43 or to a position close thereto. The sensor 111 outputs an ON signal when the sheet feed unit 10 or the sheet feed table 50 as it rises causes the cut sheets 68 or 69 to contact the pick-up rollers 43 and to lift then up to the sheet feed position P2; otherwise the sheet feed upper limit sensor 111 outputs an OFF signal. When the sheet feed upper limit sensor 111 is turned on, the cut sheets 68 or 69 may be fed by the pick-up rollers 43.

A T-T lower limit sensor 112 is located in a T-T lower limit position P3 a little lower than the middle of the sheet feed unit 10. The sensor 112 outputs an ON signal when the sheet feed table 50 reaches the T-T lower limit position P3. The T-T lower limit sensor 112 outputs an OFF signal when the sheet feed table 50 is above the T-T lower limit position P3.

A K-K lower limit sensor 113 is attached to a K-K lower limit position at the bottom of the sheet feed unit 10. The sensor 113 outputs an ON signal only when the sheet feed unit 10 is in the K-K lower limit position P4; otherwise the sensor 113 outputs an OFF signal.

A cassette sensor 114 is attached to the cassette plate 12. The cassette sensor 114 outputs an ON signal when the cassette K is mounted on the cassette plate 12; otherwise the sensor 114 outputs an OFF signal. The cassette sensor 114 may illustratively be constituted by a magnet on the cassette K and by a reed switch in that position of the cassette plate 12 which comes opposite to the magnet of the cassette K when the latter is mounted.

The position of the magnet on the cassette K may be altered according to the size of the cut sheets 69 contained in the cassette, and the relocated magnet may be detected by the combination of a plurality of reed switches. This arrangement makes it possible automatically to recognize the size of the cut sheets 69 through, say, four-bit value combinations whenever the cassette K is mounted on the cassette plate 12.

A cover sensor 115 detects the swinging status of the cover 67 and is composed illustratively of a microswitch. A power switch 116 is used to turn on and off the main power of the cut sheet feeder 1.

A table sheet presence sensor 117 is attached to the sheet feed table 50. The sensor 117 detects the presence and absence of the cut sheets 68 stacked on the sheet feed table 50. The table sheet presence sensor 117 outputs an ON signal when the cut sheets 68 are present; otherwise the sensor 117 outputs an OFF signal. A cassette sheet presence sensor 118 is attached to the cassette K. The sensor 118 detects the presence and absence of the cut sheets 69 contained in the cassette K. The cassette sheet presence sensor 118 outputs an ON signal when the cut sheets 69 are contained in the cassette K; otherwise the sensor 118 outputs an OFF signal.

A jam detection means 119 detects the occurrence of jam during sheet feed operation. The jam detection means 119 outputs an ON signal Illustratively when the pick-up rollers 43 fail to feed a cut sheet 68 or 69 all the way into the printing machine 2, i.e., the sheet jammed halfway through the sheet transport route.

The sheet feed control means 100 controls the motor 8 and the clutches 9*a* and 9*b* so as to lift and lower the sheet feed unit 10 and the sheet feed table 50 singly or in combination. In the T mode, the T-K home position P1 in which the T-K home sensor 110 is turned on is taken as the reference sheet feed position for the sheet feed unit 10. Between the sheet feed position P2 and the T-T lower limit position P3 (see FIG. 8), the sheet feed table 50 is lifted and lowered under control of the sheet feed control means 100.

In the K mode, the K-K lower limit position P4 in which the K-K lower limit sensor 113 is turned on is taken as the reference cassette feed position for the sheet feed unit 10. The sheet feed unit 10 is lifted and lowered under control of the sheet feed control means 100 between the K-K lower limit position P4 on the one hand, and the position where the topmost cut sheet 69 in the cassette K contacts the sheet feed upper limit sensor 111 and activates it, on the other. It should be noted that the sheet feed table 50 is lifted and lowered within the sheet feed unit 10.

Figure 9:
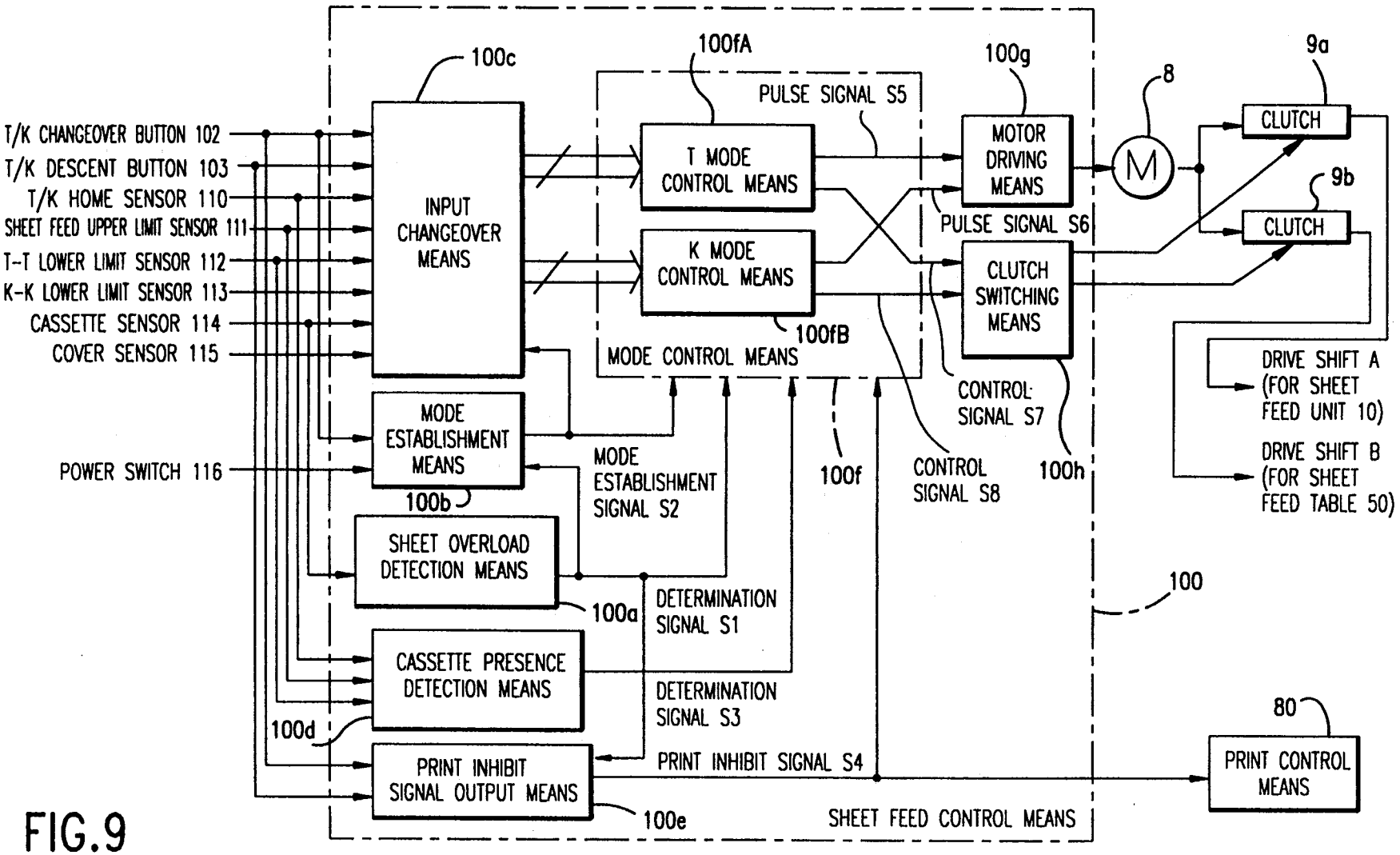
FIG. 9 is a block diagram depicting the constitution of the feed-related control means in the cut sheet feeder.

The constitution of the sheet feed control means 100 will be described further with reference to the function block diagram of FIG. 9. The sheet feed control means 100 comprises cassette presence detection means 100*a*, mode establishment means 100*b*, input changeover means 100*c*, sheet overload detection means 100*d*, print inhibit signal output means 100*e*, mode control means 100*f*, motor driving means 100*g*, and clutch switching means 100*h*.

The cassette presence detection means 100*a* checks to see if the cassette X is mounted on the cassette plate 12 in accordance with the detection signal from the cassette sensor 114. The ON or OFF signal from the cassette sensor 114 allows the presence or absence of the cassette K to be determined. A determination signal S1 reflecting the result of the detection is output to the mode establishment means 100*b*, the mode control means 100*f* and the print inhibit signal output means 100*e*. The cassette sensor 114 and cassette presence detection means 100*a* constitute the generic cassette presence detection means.

The mode establishment means 100*b* establishes either the T mode in which cut sheets are fed from the sheet feed table 50, or the K mode in which cut sheets are fed from the cassette K, on the basis of the determination signal S1 from the cassette presence detection means 100*a* and of the ON/OFF signal from the power switch 116. Pushing the T/K changeover button 102 switches the current operation mode to the other mode. With either the T mode or the K mode established, the mode establishment means 100*b* outputs a mode establishment signal S2 designating the established mode to the input changeover means 100*c* and the mode control means 100*f*.

Upon receipt of the mode establishment signal S2 from the mode establishment means 100*b*, the input changeover means 100*c* selectively switches the detection signals from the buttons 102 and 103 as well as from the sensors 110 through 115. The selected detection signal is output to the mode control means 100*f*.

The sheet overload detection means 100*d* checks the cut sheets 68 on the sheet feed table 50 for sheet overload on the basis of the detection signals from the T-K home sensor 110, from the sheet feed upper limit sensor 111 and from the T-T lower limit sensor 112. A determination signal S3 reflecting the result of the check is output by the means 100*d* to the mode control means 100*f*. If a sheet overload condition is detected, that condition is displayed on the display unit 104, announced by voice, or indicated by other suitable means.

The print inhibit signal output means 100*e* outputs a print inhibit signal S4 when the T/K changeover button 102 or T/K descent button 103 is pushed on the control panel 101. The print inhibit signal S4 when output disables the operation of the print start button 82 and thus inhibits the print control means 80 of the printing machine 2 from starting print operation. The print inhibit signal output means 100*e* further receives the determination signal S1 from the cassette presence detection means 100*a*. As will be described later, the print inhibit signal output means 100*e* also outputs the print inhibit signal S4 when the determination signal S1 reflecting the presence of the cassette is input upon changeover from the K mode to the T mode.

The mode control means 100*f* comprises T mode control means 100*f*A and K mode control means 100*f*B. The T mode control means 100*f*A controls the operation of the T mode, to be described later in more detail, upon receipt of the mode establishment signal S2 designating the T mode from the mode establishment means 100*b*. The T mode control means 100*f*A also receives the signals from the buttons 102 and 103 and the detection signals from the sensors 110 through 119. In turn, the T mode control means 100*f*A supplies the motor driving means 100*g* with a pulse signal S5 for rotating the motor 8 in the forward or reverse direction.

On receiving the determination signal S1 from the cassette presence detection means 100*a*, the determination signal S3 from the sheet overload detection means 100*d*, or the print inhibit signal S4 from the print inhibit signal output means 100*e*, the T mode control means 100*f*A controls the motor 8 accordingly. In lifting or lowering the sheet feed unit 10 and the sheet feed table 50, the T mode control means 100*f*A outputs to the clutch switching means 100*h* a control signal S7 for switching the clutches 9*a* and 9*b* in the T mode.

The K mode control means 100*f*B controls the operation of the K mode upon receipt of the mode establishment signal S2 designating the K mode from the mode establishment means 100*b*. On further receiving the input signals from the buttons 102 and 103 and the detection signals from the sensors 110 through 119 via the input changeover means 100*c*, the K mode control means 100*f*B supplies the motor driving means 100*g* with a pulse signal S6 for rotating the motor 8 in the forward or reverse direction.

Upon input of the determination signal S1 from the cassette presence detection means 100*a*, the determination signal S3 from the sheet overload detection means 100*d* or the print inhibit signal S4 from the print inhibit signal output means 100*e*, the K mode control means 100*f*B controls the motor 8 accordingly. In lifting or lowering the sheet feed unit 10 and the sheet feed table 50, the T mode control means 100*f*A outputs to the clutch switching means 100*h* a control signal S8 for switching the clutches 9*a* and 9*b* in the K mode.

The motor driving means 100*g* receives the pulse signal S5 from the T mode control means 100*f*A or the pulse signal S6 from the K mode control means 100*f*B. Depending on the pulse signal received, the motor driving means 100*g* causes the motor 8 to rotate in the forward or reverse direction.

With the motor 8 controlled in rotation, the clutch switching means 100*h* switches the clutches 9*a* and 9*b* in the operation mode designated by the control signal S7 or S8 from the T mode control means 100*f*A or from the K mode control means 100*f*B. The setup above provides control over three kinds of up-down movement: the movement of the sheet feed unit 10 between the T-K home position P1 and the K-K lower limit position P4 in the T mode, the movement of he sheet feed table 50 within the sheet feed unit 10, and the movement of the cassette K between the sheet feed upper limit sensor 111 and the K-K lower limit position P4 in the K mode.

Figure 10:
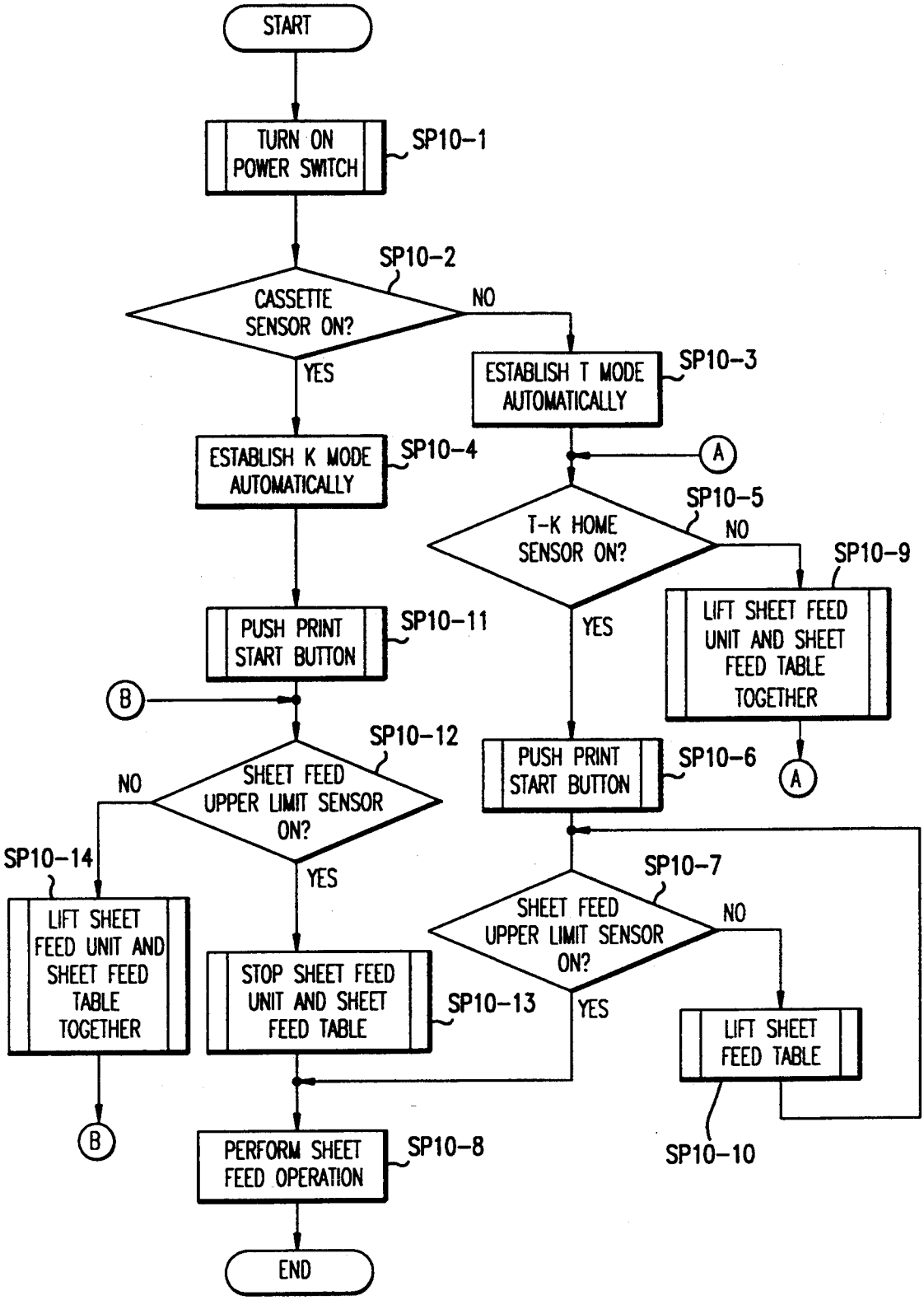
FIG. 10 is a flowchart of steps showing the initial operation of the cut sheet feeder when it is powered.

The control operation of the sheet feed control means 100 will now be described with reference to the flowchart of FIG. 10 and other accompanying drawings. FIG. 10 shows the steps constituting the initial operation of the cut sheet feeder when it is powered. When the power switch 116 is turned on (step 10-1), a check is made to see if the cassette K is mounted on the cassette plate 12. The check is made in accordance with the determination signal S1 from the cassette presence detection means 100*a* based on the detection signal from the cassette sensor 114 (step 10-2).

If the cassette K is not mounted on the cassette plate 12 and the cassette sensor 114 outputs an OFF signal (NO in step 10-2), the mode establishment means 100*b* establishes the T mode automatically (step 10-3). If, with the power switch 116 turned on, the cassette K is mounted on the cassette plate 12 and the cassette sensor 114 outputs an ON signal (YES in step 10-2), then the mode establishment means 100*b* establishes the K mode automatically based on the determination signal S1 (step 10-4).

When the T mode is established automatically, the mode establishment signal S2 from the mode establishment means 100*b* activates the T mode control means 100*f*A. In the T mode, the T mode control means 100*f*A brings the top surface of the cut sheets 68 into contact with the pickup rollers 43 based on the detection signals from the T-K home sensor 110 and from the sheet feed upper limit sensor 111. This allows the pick-up rollers 43 to feed the cut sheets 68 from the sheet feed table 50. The control operations involved are as follows:

When the sheet feed unit 10 is set to the T-K home position P1, i.e., the reference table sheet feed position in the T mode shown in FIG. 6(*a*), a check is made to see if the T-K home sensor 110 outputs an ON signal. If the T-K home sensor 110 is found to be on (YES in step 10-5), the print start button 82 of the printing machine 2 is pushed (step 10-6). This executes another check to see if the sheet feed upper limit sensor 111 outputs an ON signal. If the sensor 111 is found to be on (YES in step 10-7), the top surface of the stacked cut sheets 68 is in contact with the pick-up rollers 43. Then the cut sheet feeder 1 starts feeding the cut sheets 68 into the printing machine 2 (step 10-8).

Figure 11A:
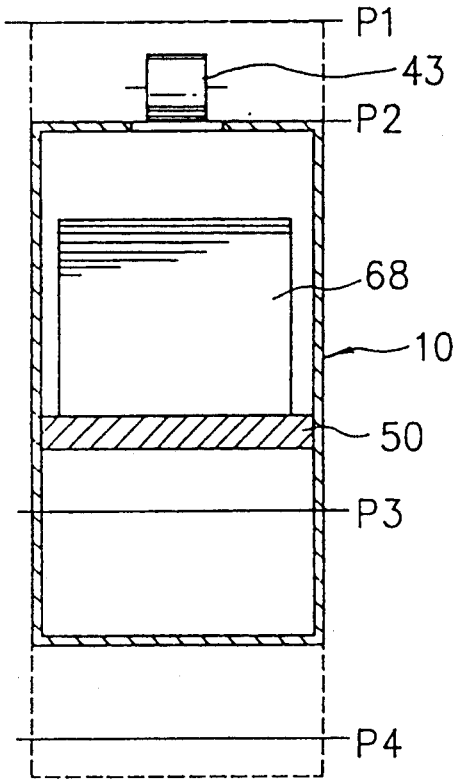
FIG. 11(*a*) is a view of the status of the cut sheet feeder in the table feed mode prior to actual sheet feed.
Figure 11B:
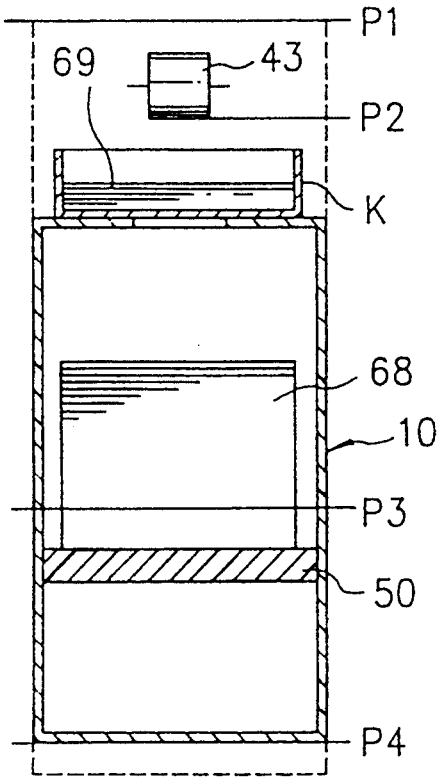

In the T mode, if the sheet feed unit 10 is not in the reference table sheet feed position and is below the pick-up rollers 43 as shown in FIG. 11(*a*), the cut sheets 68 are not in contact with the pick-up rollers 43 and sheet feed operation cannot be executed. In that case, the T-K home sensor 110 outputs an OFF signal (NO in step 10-5). Then with the two clutches 9*a* and 9*b* engaged, the motor 8 is rotated in the forward direction so that the sheet feed unit 10 and the sheet feed table 50 will be lifted together by the same amount (step 10-9).

As the sheet feed unit 10 rises and reaches the reference table sheet feed position as shown in FIG. 6(*a*), the T-K home sensor 110 outputs an ON signal (YES in step 10-5). When the print start button 82 of the printing machine 2 is pushed (step 10-6) and the sheet feed upper limit sensor 111 outputs an ON signal (YES in step 10-7), the cut sheet feeder 1 starts feeding the cut sheets 68 into the printing machine 2 (step 10-8).

At this point, a check is made to see if the sheet feed upper limit sensor 111 outputs an OFF signal. If the sensor 111 does output the OFF signal (NO in step 10-7), the sheet feed table 50 alone is raised until the sheet feed upper limit sensor 111 outputs an ON signal (step 10-10).

When the K mode is automatically established, the mode establishment signal S2 from the mode establishment means 100*b* activates the K mode control means 100*f*B. In the K mode, the K mode control means 100*f*B brings the top surface of the cut sheets 69 in the cassette K into contact with the pick-up rollers 43 based on the detection signal from the sheet feed upper limit sensor 11. This allows the pick-up rollers 43 to feed the cut sheets 69 from the cassette K. The control operations involved are as follows:

When the K mode is automatically established, the print start button 82 of the printing machine 2 may be pushed (step 10-11). If the sheet feed upper limit sensor 111 outputs an ON signal (YES in step 10-12) in the state shown in FIG. 6(*b*), the top surface of the cut sheets 69 is in contact with the pick-up rollers 43. At this point, the sheet feed unit 10 and the sheet feed table 50 are stationary (step 10-13). The cut sheet feeder 1 then starts feeding the cut sheets 69 into the printing machine 2 (step 10-8).

By contrast, as shown in FIG. 11(*b*), it may happen that the cassette K is positioned lower than the pick-up rollers 43. This means no contact between the cut sheets 69 and the pick-up rollers 43, and sheet feed operation cannot be performed. In that case, with the print start button 82 of the printing machine pushed (step 10-11), the sheet feed upper limit sensor 111 outputs an OFF signal (NO in step 10-12). With the clutches 9*a* and 9*b* engaged, the OFF signal from the sensor 111 causes the motor to rotate in the forward direction so that the sheet feed unit 10 and the sheet feed table 50 will be lifted together by the same amount (step 10-14).

As the sheet feed unit 10 rises and reaches the position shown in FIG. 6(*b*) where the sheet feed upper limit sensor 111 outputs an ON signal (YES in step 10-12), the lifting of the sheet feed unit 10 and sheet feed table 50 is stopped (step 10-13). The cut sheet feeder 1 then starts feeding the cut sheets 69 into the printing machine 2 (step 10-8).

What follows is a description of how to change the currently established operation mode. If the current operation mode is the T mode, pushing the T/K changeover button 102 causes the mode establishment means 100*b* to output the mode establishment signal S2 designating the K mode. The K mode control means 100*f*B then carries out necessary processing. If the current operation mode is the K mode, pushing the T/K changeover button 102 triggers the output of the mode establishment signal S2 designating the T mode. Thereafter, the T mode control means 100*f*A performs necessary processing.

Figure 12:
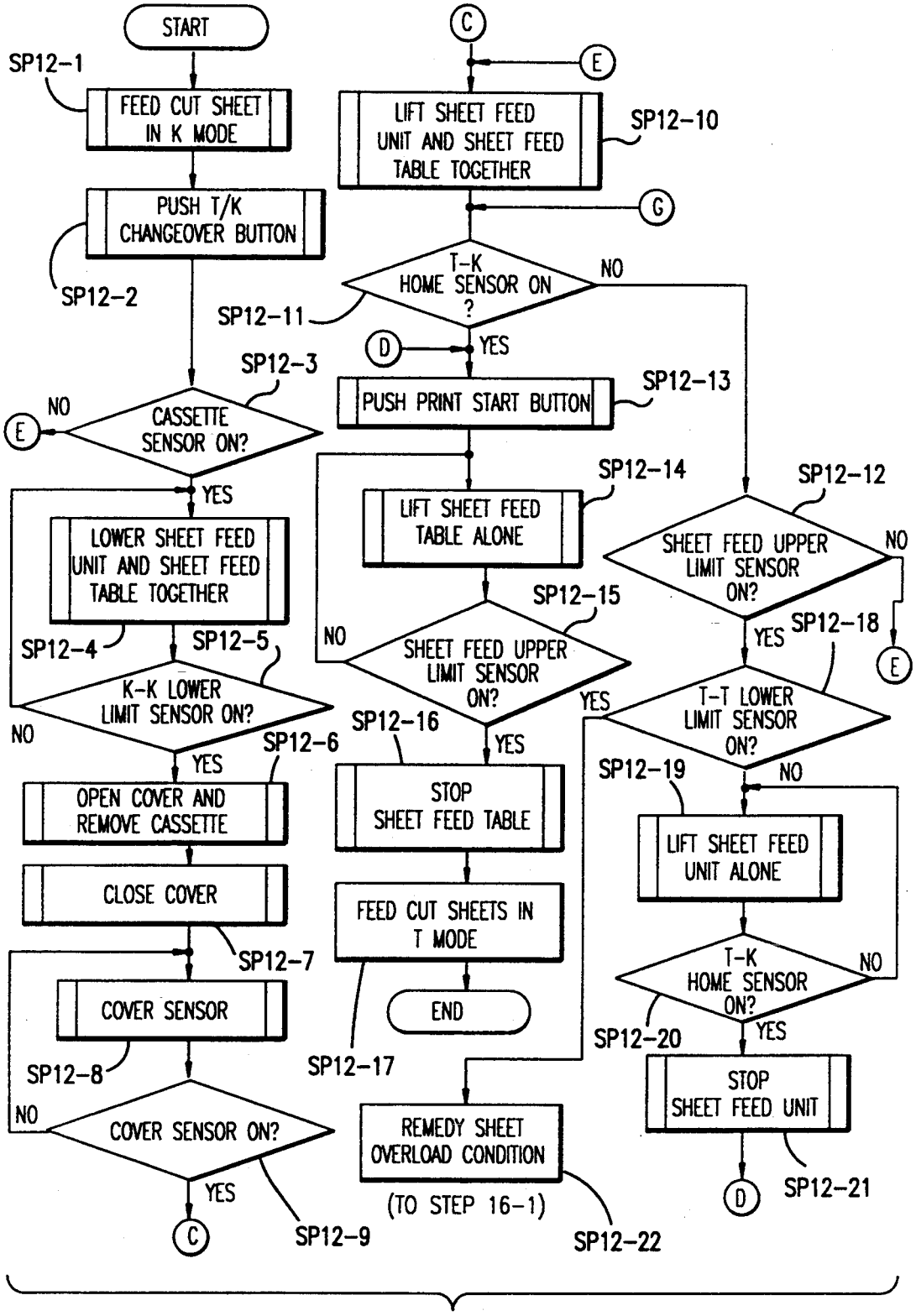
FIG. 12 is a flowchart of steps in which the cut sheet feeder is switched from the cassette feed mode to the table feed mode.

The changeover from the K mode as the current operation mode to the T mode, effected by pushing the T/K changeover button 102, will now be described in more detail with reference to the flowchart of FIG. 12. Since the current operation mode is the K mode (step 12-1), the T/K changeover button 102 is pushed (step 12-2). This executes a check to see if the cassette sensor 114 outputs an ON signal indicating the presence of the cassette K on the cassette plate 12. If the cassette sensor 114 does output the ON signal (YES in step 12-3), steps are taken to remove the cassette K from the cassette plate 12. If the cassette K is not mounted on the cassette plate 12, the steps for cassette removal are skipped and step 12-10 is reached.

When the cassette sensor 114 outputs the ON signal, the cassette presence detection means 100*a* outputs the determination signal S1 indicating the presence of the cassette K. This causes the print inhibit signal output means 100*e* to output the print inhibit signal S4 to the print control means 80. The print inhibit signal S4 disables the operation of the print start button 82 of the printing machine 2 and thereby inhibits print operation.

When the cassette K is left mounted on the cassette plate 12, with the ON signal output by the cassette sensor 114, pushing the T/K changeover switch 102 (step 12-2) executes a check to see if the sensor 114 keeps outputting the ON signal. While the cassette sensor 114 remains on (YES in step 12-3), the motor 8 is rotated in reverse by engaging the clutches 9*a* and 9*b* so that the sheet feed unit 10 and the sheet feed table 50 will be lowered together by the same amount (step 12-4).

The sheet feed unit 10 and the sheet feed table 50 are allowed to descend until the K-K lower limit sensor 113 outputs an ON signal (YES in step 12-5). The unit 10 and the table 50 are then stopped (step 12-6). With the sheet feed unit 10 in its lower limit position, the presence of the cassette K on the cassette plate 12 is displayed on the display unit 104, announced by voice, or indicated by other suitable means. In this state, the cover 67 is opened and the cassette K is removed from the cassette plate 12 (step 12-7). The cassette sensor 114 then outputs an OFF signal.

Figure 13A:
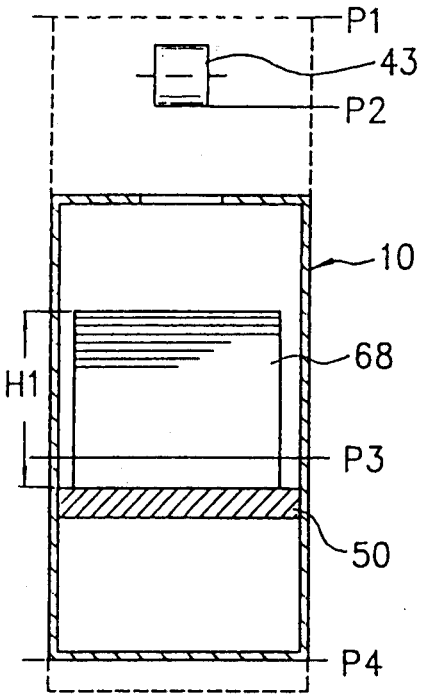
FIGS. 13(*a*), 13(*b*) and 13(*c*) are views showing how cut sheets in the cut sheet feeder in the table feed mode change from insufficient to sufficient in terms of quantity for sheet feed.
Figure 13B:
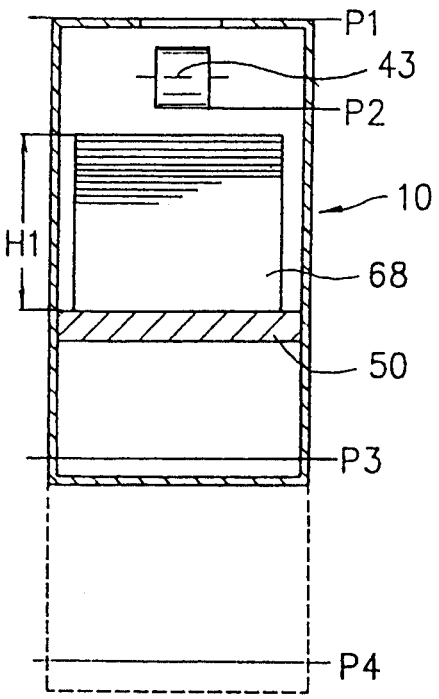

When the cover 67 is closed (step 12-8) and the cover sensor 115 outputs an ON signal (YES in step 12-9), the sheet feed unit 10 and the sheet feed table 50 are now ready to be lifted according to the selected mode. The lift operation takes place as follows:

Depending on the amount of the cut sheets 68 on the sheet feed table 50, one of the processes illustrated in FIGS. 13(*a*), 13(*b*), 13(*c*), 14(*a*), 14(*b*), 14(*c*), 15(*a*) and 15(*b*) is selectively executed. When the amount of the cut sheets 68 is within a range H1 (the appropriate range), the process depicted in FIG. 13(*a*), 13(*b*), and 13(*c*) is carried out. Suppose that, with the T/K changeover button 102 pushed, the sheet feed unit 10 is not in the reference table sheet feed position, that the T-K home sensor 110 outputs an OFF signal (NO in step 12-11), and that the sheet feed upper limit sensor 111 outputs an OFF signal (NO in step 12-12), as depicted in FIG. 13(*a*). In that case, with the clutches 9*a* and 9*b* engaged, the motor 8 is rotated in the forward direction so that the sheet feed unit 10 and the sheet feed table 50 will be lifted together by the same amount (step 12-10).

Figure 13C:
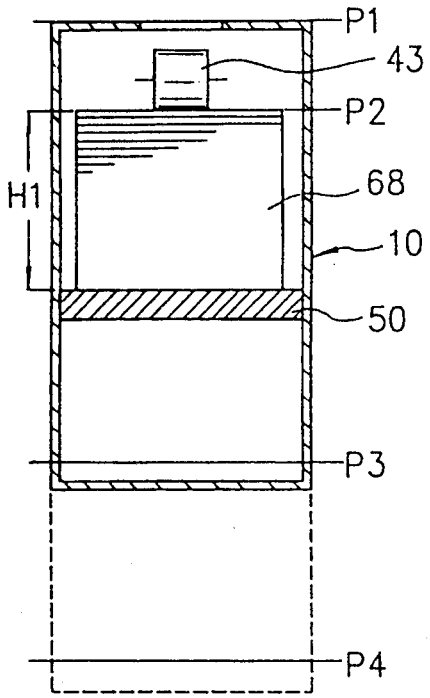

As shown in FIG. 13(*b*), the sheet feed unit 10 then reaches the reference table sheet feed position and the T-K home sensor 110 outputs an ON signal (YES in step 2-11). After this, pushing the print start button 82 of the printing machine 2 (step 12-13) disengages the clutch 9*a* alone and allows only the sheet feed table 50 to rise (step 12-14) until the sheet feed upper limit sensor 111 outputs an ON signal (YES in step 12-15). When the cut sheets 68 come into contact with the pick-up rollers 43 as shown in FIG. 13(C), the sheet feed upper limit sensor 111 outputs the ON signal that stops the sheet feed table 50 (step 12-16). Sheet feed operation thus starts in the T mode (step 12-17).

Figure 14A:
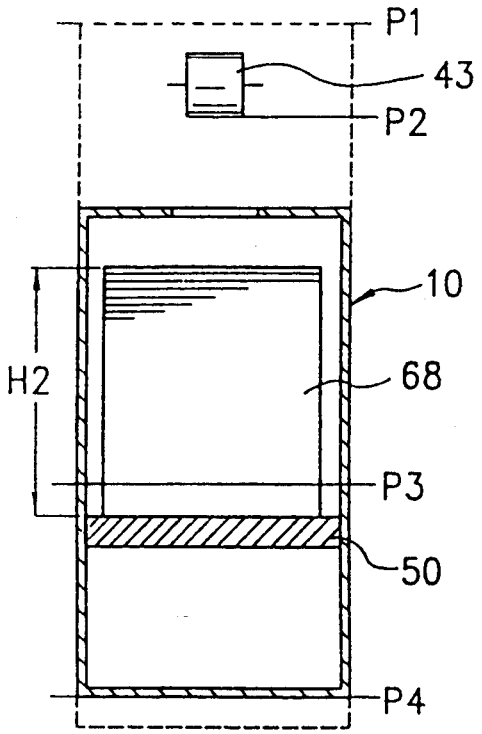
FIGS. 14(*a*), 14(*b*) and 14(*c*) are views depicting how cut sheets in the cut sheet feeder in the table feed mode reach the upper limit of the sufficient quantity for sheet feed.
Figure 14B:
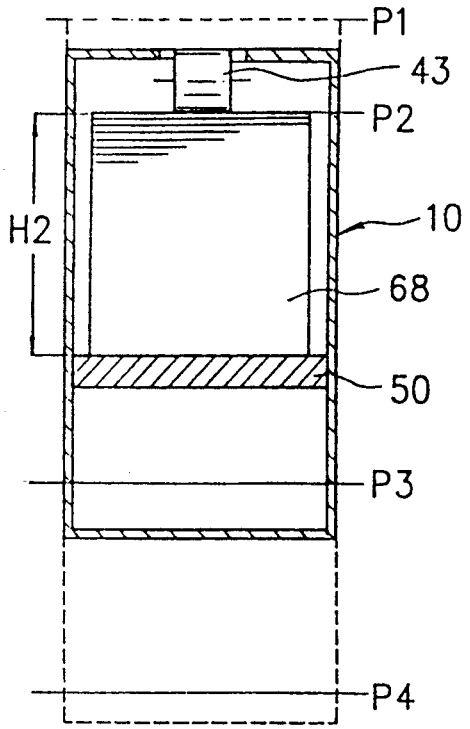
Figure 14C:
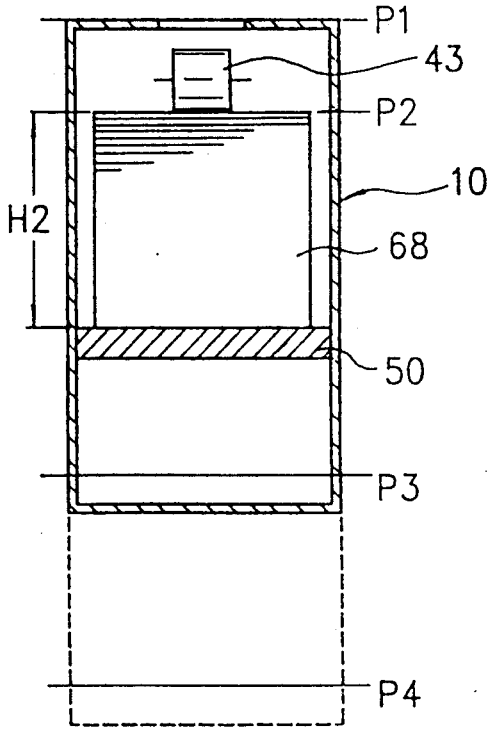

The case where the amount of the cut sheets 68 is at the maximum allowable height H2 as illustrated in FIG. 14(*c*) will now be described. Suppose that, with the T/K changeover button 102 pushed, the sheet feed unit 10 is not in the reference table sheet feed position, that the T-K home sensor 110 outputs an OFF signal (NO in step 12-11), and that the sheet feed upper limit sensor 111 outputs an OFF signal (NO in step 12-12), as depicted in FIG. 14(*a*). In that case, with the clutches 9*a* and 9*b* engaged, the motor 8 is rotated in the forward direction so that the sheet feed unit 10 and the sheet feed table 50 will be lifted together by the same amount (step 12-10).

As shown in FIG. 14(*b*), before the sheet feed unit 10 reaches the reference table sheet feed position, the T-K home sensor 110 keeps outputting an OFF signal (NO in step 12-11). In this state, the top surface of the cut sheets 68 on the sheet feed table 50 comes into contact with the pick-up rollers 53. This turns on the sheet feed upper limit sensor 111 (YES in step 12-12) and leaves the T-T lower limit sensor 112 turned off (NO in step 12-18). The clutch 9*b* alone is then disengaged and only the sheet feed unit 10 is allowed to rise (step 12-19).

When the sheet feed unit 10 has reached its upper limit position and the T-K home sensor 110 outputs an ON signal (YES in step 12-20) as illustrated in FIG.

14(C), the lifting of the sheet feed unit 10 stops (step 12-21). The print start button 82 of the printing machine 2 is then pushed (step 12-13), and subsequent steps are carried out.

Figure 15A:
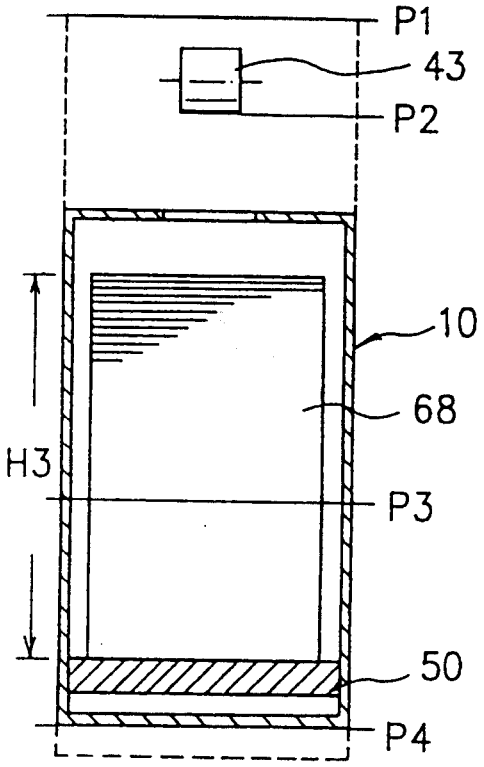
FIGS. 15(*a*) and 15(*b*) are views indicating how an excess amount of stacked cut sheets is detected in the cut sheet feeder in the table feed model
Figure 15B:
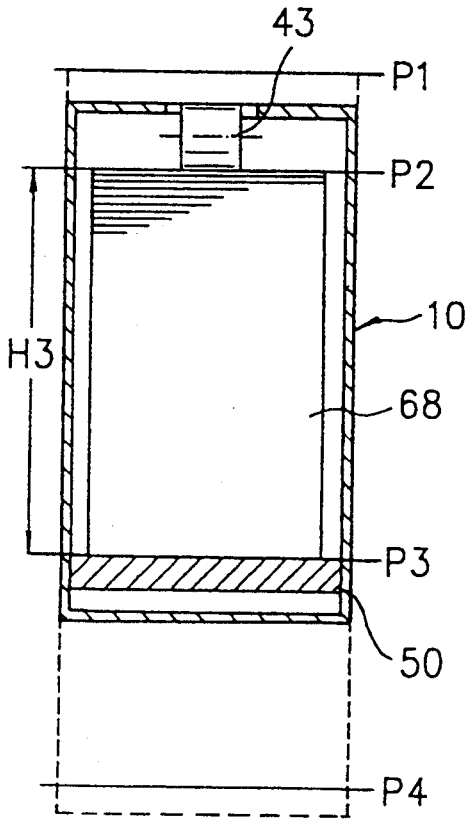

The case where the amount of the cut sheets 68 is at a height H3 exceeding the maximum allowable height, as illustrated in FIG. 15, will now be described. In that case, with the T/K changeover button 102 pushed, the sheet feed unit 10 and the sheet feed table 50 may be positioned as shown in FIG. 15(*a*). That is, the sheet feed unit 10 is not in the reference table sheet feed position, the T-K home sensor 110 outputs an OFF signal (NO in step 12-11), and the sheet feed upper limit sensor 111 also outputs an OFF signal (NO in step 12-12). Then with the clutches 9*a* and 9*b* engaged, the motor 8 is rotated in the forward direction so that the sheet feed unit 10 and the sheet feed table 50 will be lifted together by the same amount (step 12-10).

Thereafter, the state of FIG. 15(*b*) may occur. That is, with the sheet feed unit 10 yet to reach the reference table sheet feed position, i.e., with the OFF signal coming from the T-K home sensor 110 (NO in step 12-11), the sheet feed upper limit sensor 111 outputs an ON signal (YES in step 12-12) and the T-T lower limit sensor 112 also outputs an ON signal (YES in step 12-18). This state involves an excess amount of cut sheets 68 stacked on the sheet feed table 50. Under the excess amount of its cut sheets, the sheet feed table 50 is impeding the sheet feed unit 10 from being lifted up to the reference table sheet feed position. In that case, the sheet overload detection means 100*d* recognizes a sheet overload condition based on the detection signals from the sensors involved, and the process of recovery from sheet overload is carried out (starting from step 12-22).

Figure 16:
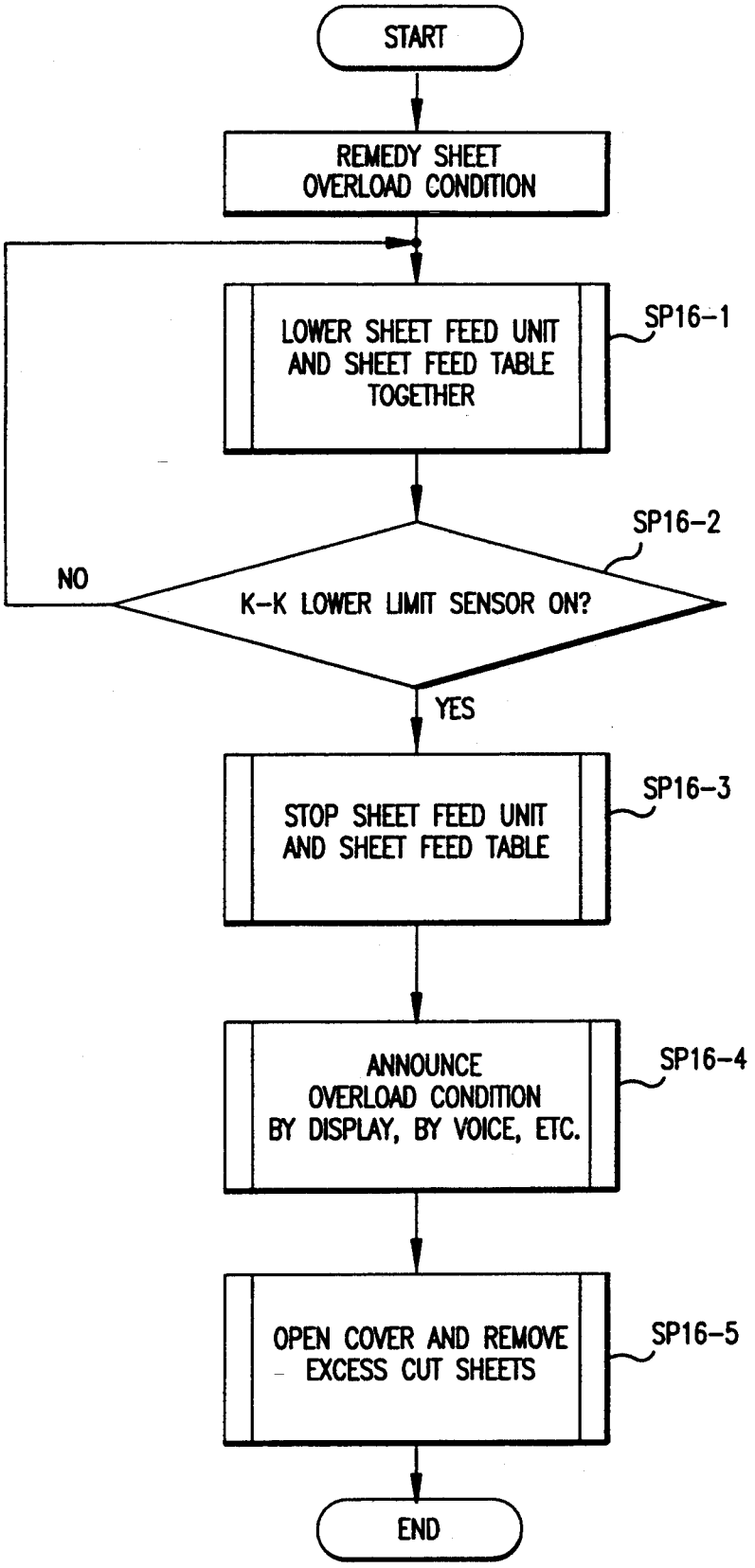
FIG. 16 is a flowchart of steps in which to remedy the status of the cut sheet feeder containing an excess amount of stacked cut sheets.

The sheet overload recover process will now be described with reference to the flowchart of FIG. 16. The sheet feed unit 10 and the sheet feed table 50 are first lowered together by the same amount (step 16-1).

The sheet feed unit 10 stops in the K-K lower limit position P4 (step 16-3). The sheet overload condition is indicated visually, by voice, or by other suitable means (step 16-4). In this state, the cover 67 is opened and the excess cut sheets 68 are removed from the sheet feed table 50 (step 16-5). Closing the cover 67 completes the sheet overload recovery process (step 12-21). After this, the sheet feed operation in the T mode outlined in FIG. 12 is resumed (by going to step 12-10).

Alternatively, the sheet feed unit 10 and the sheet feed table 50 need not be lowered to the K-K lower limit position P4. Instead, the sheet feed table 50 may be positioned just low enough for the top surface of the cut sheets 68 to leave a sufficient clearance against the pick-up rollers 43 whereby the excess cut sheets 68 may be removed.

Figure 17:
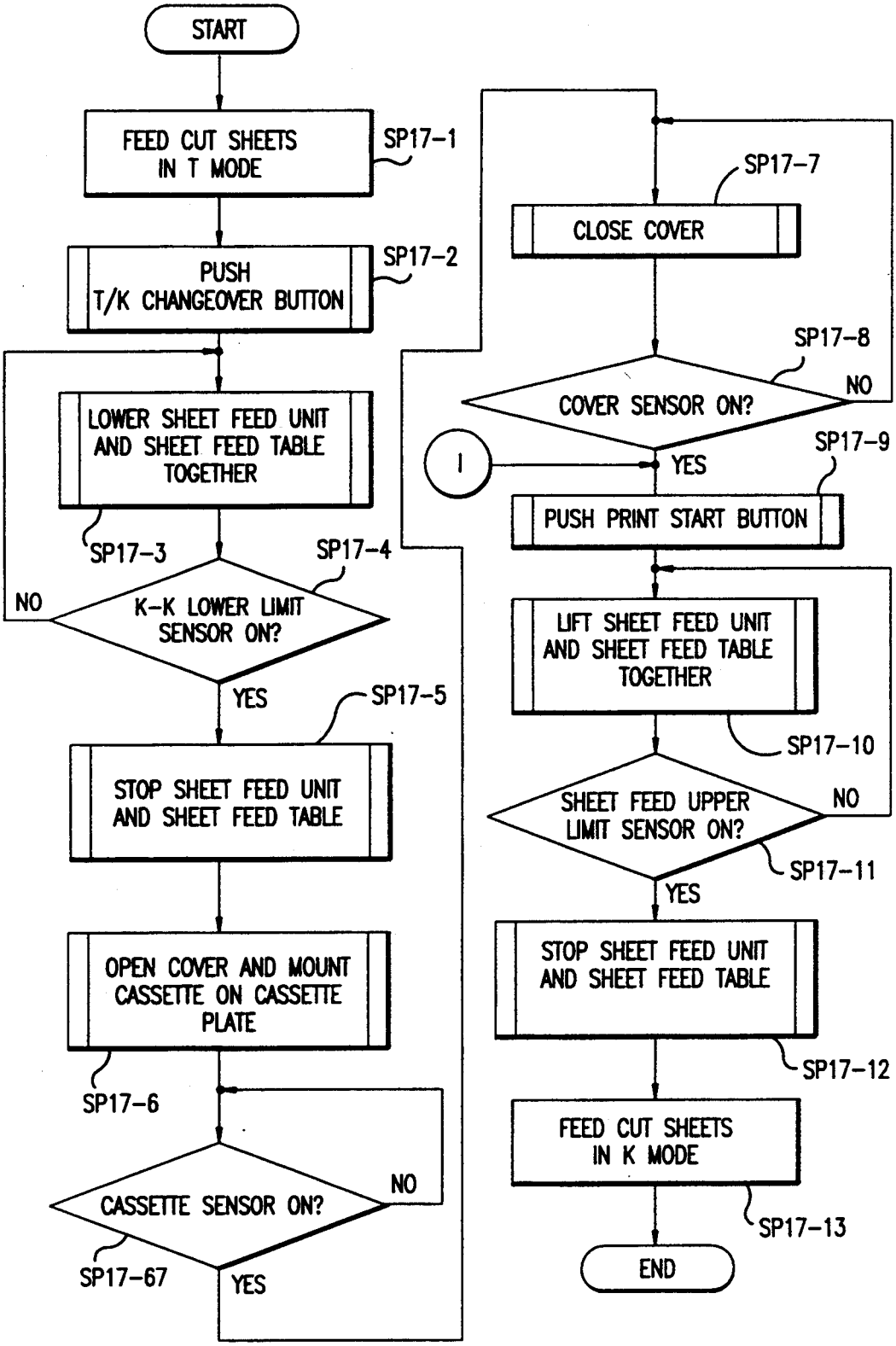
FIG. 17 is a flowchart of steps in which the cut sheet feeder is switched from the table feed mode to the cassette feed mode.

The operations involved when the T/K changeover button 102 is pushed for changeover to the K mode will now be described with reference to the flowchart of FIG. 17. Since the current operation mode is the T mode (step 17-1), the sheet feed unit 10 is in the state of FIG. 13(C) (or in the state of FIG. 14(C), which is the same state). That is, the sheet feed unit 10 is in the reference table sheet feed position, i.e., the T-K home position P1; the sheet feed table 50 is positioned between the sheet feed upper limit position P2 and the T-T lower limit position P3. To select the K mode requires lowering the sheet feed unit 10 and the sheet feed table 50 and placing the cassette K on the cassette plate 12 so that the top surface of the cut sheets 69 will contact the pick-up rollers 43.

When the T/K changeover button 102 is pushed (step 17-2), the clutches 9*a* and 9*b* are engaged and the motor 8 is rotated in reverse so that the sheet feed unit 10 and the sheet feed table 50 will be lowered together by the same amount (step 17-3). When the K-K lower limit sensor 113 outputs an ON signal (YES in step 17-4), the descent of the sheet feed unit 10 and sheet feed table 50 is stopped (step 17-5).

In this state, the cover 67 is opened and the cassette K is mounted on the cassette plate 12 (step 17-6). After the cassette sensor 114 outputs an ON signal (step 17-67), closing the cover (step 17-7) causes the cover sensor 115 to output an ON signal (YES in step 17-8). When the print start button 82 of the printing machine 2 is pushed (step 17-9), the clutches 9*a* and 9*b* are engaged and the motor 8 is rotated in the forward direction so that the sheet feed unit 10 and the sheet feed table 50 will be lifted together by the same amount (step 17-10).

When the sheet feed upper limit sensor 111 outputs an ON signal (YES in step 17-11), the lifting of the sheet feed unit 10 and sheet feed table 50 stops (step 17-12). The cut sheet feeder 1 then starts feeding the cut sheets 69 into the printing machine 2 in the K mode (step 17-13).

During sheet feed operation, jamming may occur or it may become necessary to replenish cut sheets or to replace the currently set cut sheets with those of a different size. In such cases, pushing the T/K descent button 103 causes the T mode control means 100*f*A or the K mode control means 100*f*B, whichever is in effect depending on the current operation mode, to control the lowering of the sheet feed unit 10 and the sheet feed table 50.

Figure 18:
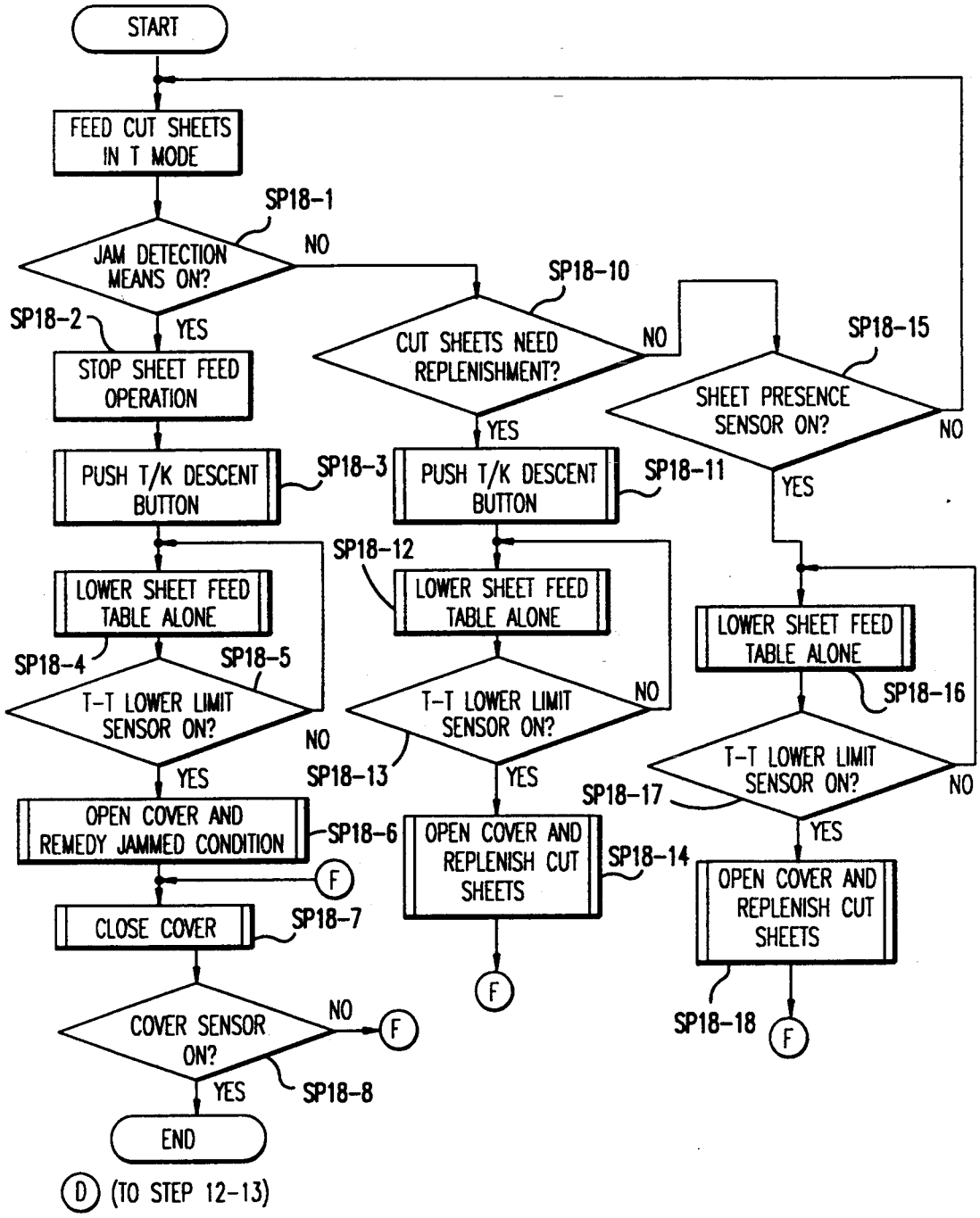
FIG. 18 is a flowchart of steps in which the cut sheet feeder in the table feed mode is remedied from sheet jamming and is replenished with cut sheets.

How jamming is remedied or cut sheets are replenished in the T mode will now be described with reference to the flowchart of FIG. 18. If a jam is detected by the jam detection means 119 during sheet feed operation in the T mode (YES in step 18-1), the jammed condition is indicated on the display unit 104 and the sheet feed operation stops automatically (step 18-2).

Then pushing the T/K descent button 103 (step 18-3) causes the motor 8 to rotate in reverse with only the clutch 9*b* engaged. The sheet feed table 50 alone is lowered (step 18-4) until the T-T lower limit sensor 112 outputs an ON signal (YES in step 18-5). In this state, the cover 67 is opened and the jammed sheet is removed (step 18-6).

With the jammed condition remedied and the cover 67 closed (step 18-7), the cover sensor 115 outputs an ON signal (YES in step 18-8). When the print start button 82 of the printing machine 2 is pushed, the sheet feed operation of the T mode is resumed as described above (by going to step 12-13 of FIG. 12).

During sheet feed operation in the T mode, it may become necessary to replenish the sheet feed table 50 with more cut sheets 68 or to replace the currently set cut sheets 68 with those of a different size (YES in step 18-10). In that case, the print operation including the feeding of cut sheets to the printing machine 2 is stopped for the moment by pushing a print stop button, not shown, of the printing machine 2. Then pushing the T/K descent button 103 (step 18-11) rotates the motor 8 in reverse with only the clutch 9*b* engaged. This lowers the sheet feed table 50 alone (step 18-12) until the T-T lower limit sensor 112 outputs an ON signal (YES in step 18-13).

In this state, the cover 67 is opened, an appropriate amount of cut sheets 68 is added or the sheets of a necessary size are placed on the sheet feed table 50 (step 18-14), and the width of the fences 61 is adjusted as needed. With the cut sheets 68 supplied and in place, the cover 67 is closed (step 18-7). The cover sensor 115 outputs an ON signal (YES in step 18-8). Pushing the print start button 82 of the printing machine 2 resumes the sheet feed operation of the T mode as described above (step 12-13 is reached).

If the table sheet presence sensor 117 indicates that the cut sheets have been exhausted (YES in step 18-15) during sheet feed operation of the T mode, only the clutch **9*b* is engaged and the motor 8 is rotated in reverse. The sheet feed table 50 alone is thus lowered (step 18-16) until the T-T lower limit sensor 112 outputs an ON signal (YES in step 18-17). In this state, the cover 67 is opened, an appropriate amount of cut sheets 68 is placed on the sheet feed table 50 (step 18-18), and the cover 67 is closed (step 18-7). When the cover sensor 115 outputs an ON signal (YES in step 18-8), pushing the print start button 82 of the printing machine 2 resumes the sheet feed operation of the T mode as described above (step 12-13** is reached).

Figure 19:
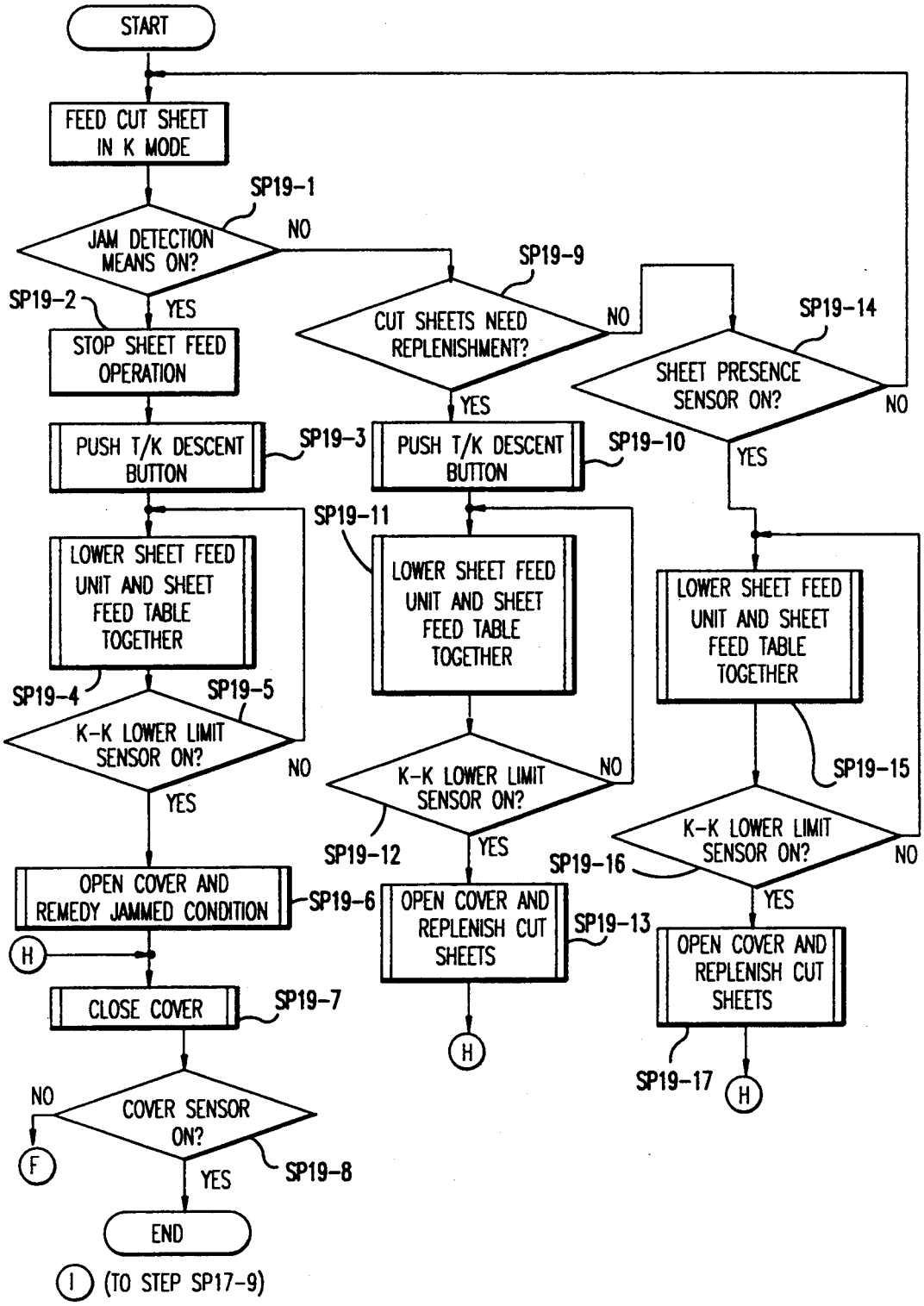
FIG. 19 is a flowchart of steps in which the cut sheet feeder in the cassette feed mode is remedied from sheet jamming and is replenished with cut sheets.

How jamming is remedied or cut sheets are replenished in the K mode will now be described with reference to the flowchart of FIG. 19. If a jam is detected by the jam detection means 119 during sheet feed operation in the K mode (YES in step 19-1) as in the case of the T mode, the jammed condition is indicated on the display unit 104 and the sheet feed operation stops automatically (step 19-2).

Then pushing the T/K descent button 103 (step 19-3) causes the motor 8 to rotate in reverse with the clutches **9*a* and 9*b* engaged. This lowers the sheet feed unit 10 and the sheet feed table 50 together by the same amount (step 19-4) until the K-K lower limit sensor 113 outputs an ON signal (YES in step 19-5**).

In this state, the cover 67 is opened and the jammed sheet is removed (step 19-6). With the jammed condition remedied and the cover 67 closed (step 19-7), the cover sensor 115 outputs an ON signal (YES in step 19-8). When the print start button 82 of the printing machine 2 is pushed, the sheet feed operation of the K mode is resumed as described above (by going to step 17-9).

During sheet feed operation in the K mode, it may become necessary to replenish the cassette K with more cut sheets 69 (YES in step 19-9). In that case, the print operation including the feeding of cut sheets to the printing machine 2 is stopped for the moment by pushing the print stop button, not shown, of the printing machine 2. Then pushing the T/K descent button 103 (step 19-10) rotates the motor 8 in reverse with the clutches **9*a* and 9*b* engaged. The sheet feed unit 10 and the sheet feed table 50 are thus lowered together by the same amount (YES in step 19-11) until the K-K lower limit sensor 113 outputs an ON signal (YES in step 19-12**).

In this state, the cover 67 is opened, and the cassette K is replenished with an appropriate amount of cut sheets 69 (step 19-13). With the cut sheets 69 supplied and in place, the cover 67 is closed (step 19-7). The cover sensor 115 outputs an ON signal (YES in step 19-8). Pushing the print start button 82 of the printing machine 2 resumes the sheet feed operation of the K mode as described above (step 17-9 is reached). For the sheet feed operation to be resumed, the sheet feed unit 10 and the sheet feed table 50 are lifted together until the sheet feed upper limit sensor 111 outputs an ON signal.

If the cassette sheet presence sensor 118 indicates that the cut sheets have been exhausted (YES in step 19-14) during sheet feed operation of the K mode, the clutches **9*a* and 9*b* are engaged and the motor 8 is rotated in reverse. The sheet feed unit 10 and the sheet feed table 50 are thus lowered together by the same amount (step 19-15) until the K-K lower limit sensor 113 outputs an ON signal (YES in step 19-16). In this state, the cover 67 is opened, an appropriate amount of cut sheets 69 is set in the cassette K (step 19-17), and the cover 67 is closed (step 19-7). When the cover sensor 115 outputs an ON signal (YES in step 19-8), pushing the print start button 82 of the printing machine 2 resumes the sheet feed operation of the K mode as described above (step 17-9** is reached).

In any of the operations of the above-described embodiment, the sheet feed unit 10 and the sheet feed table 50 remain stationary whenever the cover 67 is opened and the cover sensor 115 outputs an OFF signal.

As described, the cut sheet feeder of the invention comprises the sheet feed unit and the sheet feed table. The sheet feed unit accommodates a sheet cassette, and the sheet feed table moves up and down inside the sheet feed unit and has cut sheets stacked thereon. The sheet feed unit and the sheet feed table are lifted selectively up to a single sheet feed mechanism for sheet feed operation. This setup allows the sheet feed mechanism to pick up cut sheets selectively from the cassette or from the sheet feed table and to feed them into the image recording portion of the image forming apparatus.

Because the single sheet feed mechanism feeds cut sheets selectively from the cassette or from the sheet feed table into the image recording portion, the sheet transport route remains unchanged from the sheet feed mechanism to the image recording portion. The sheet feed timing is thus kept constant, which eliminates the need for conventional devices or adjustments to keep constant the timing of feeding cut sheets to the image forming portion. This is particularly effective in improving the print quality of mimeograph printing machines wherein a slight deviation in sheet feed timing can result in the longitudinal misalignment of printed contents.

The fact that the single sheet feed mechanism feeds cut sheets selectively from the cassette or from the sheet feed table into the image recording portion offers another benefit. That is, the structure of the sheet transport route is simplified and this route is easier to maintain than conventional sheet transport routes. With the simply structured sheet transport route taking up less space, the cut sheet feeder as a whole may be manufactured smaller than ever before.

According to the invention, when the sheet feed unit with the cassette removed is lifted, the cutout portion of the unit lets the sheet feed mechanism pass therethrough unchecked. Sheet feed operation thus proceeds from the sheet feed table with no interference between the sheet feed mechanism and the sheet feed unit lifted.

As many apparently different embodiments of this invention may be made without departing from the spirit and scope thereof, it is to be understood that the invention is not limited to the specific embodiments thereof except as defined in the appended claims.

What is claimed is:

1. A cut sheet feeder for use with an image forming apparatus, comprising:

a sheet feed mechanism for picking up stacked cut sheets one at a time from a single sheet feed position and for feeding each sheet to an image recording portion;

a sheet feed unit which is vertically movable relative to said sheet feed mechanism, to which a cassette containing cut sheets may be attached in a detachable manner, and which has a cutout portion corresponding to the position of said sheet feed mechanism;

a sheet feed table which is vertically movable within said sheet feed unit and which carries a large number of cut sheets; and sheet feed control means for lifting, in a sheet feed mode based on said cassette, at least said sheet feed unit up to a position where the cut sheets in said cassette reach the sheet feed position; and for lifting, in a sheet feed mode based on said sheet feed table, said sheet feed unit to a position where the top of said sheet feed unit comes above said sheet feed position with said cutout portion letting said sheet feed mechanism pass therethrough unchecked, thereby lifting said sheet feed table up to a position where the cut sheets on said sheet feed table reach said sheet feed position.

2. A cut sheet feeder for use with an image forming apparatus, comprising:

a sheet feed mechanism for picking up stacked cut sheets one at a time from a single sheet feed position and for feeding each sheet to an image recording portion;

a sheet feed unit which is vertically movable relative to said sheet feed mechanism, to which a cassette containing cut sheets may be attached in a detachable manner, and which has a cutout portion corresponding to the position of said sheet feed mechanism; and a sheet feed table which is vertically movable within said sheet feed unit and which carries a large number of cut sheets;

wherein said sheet feed unit and said sheet feed table are connected respectively to two clutches engaged with a motor acting as a driving source so that said sheet feed unit and said sheet feed table are vertically moved either singly or in combination depending on the switching of the clutches;

said sheet feed unit and said sheet feed table being moved in combination when the two clutches are both engaged with said motor whereas if only one of the two clutches is engaged with said motor, either said sheet feed unit or said sheet feed table connected to the engaged clutch is moved vertically.

3. A cut sheet feeder for use with an image forming apparatus according to claim 1, wherein said sheet feed unit and said sheet feed table are connected respectively to two clutches engaged with a motor, and wherein said sheet feed control means controls the switching of the two clutches so that said sheet feed unit and said sheet feed table are vertically moved either singly or in combination.

4. A cut sheet feeder for use with an image forming apparatus according to claim 1, further comprising a sheet feed upper limit sensor and cassette presence detection means, said sheet feed upper limit sensor detecting whether the cut sheets either in said sheet feed unit or on said sheet feed table are set to said sheet feed position and outputting a detection signal accordingly, said cassette presence detection means detecting the presence and absence of a cassette on said sheet feed unit and outputting a detection signal indicating either the presence or the absence of said cassette;

wherein said sheet feed control means verifies whether the sheet feed mode based on said cassette or the sheet feed mode based on said sheet feed table is in effect in accordance with the detection signal from said cassette presence detection means, and lifts either said sheet feed unit or said sheet feed table up to said sheet feed position on the basis of the detection signal from said sheet feed upper limit sensor.

5. A cut sheet feeder for use with an image forming apparatus according to claim 4, wherein said cassette presence detection means are composed of a sheet size indication member and sheet size output means, said sheet size indication member being attached to said cassette to indicate the size of the cut sheets contained therein, said sheet size output means being attached to said sheet feed unit to output a sheet size signal upon detecting size indication data coming from said sheet size indication member of said cassette.

6. A cut sheet feeder for use with an image forming apparatus according to claim 5, wherein said sheet size indication member is a magnet attached to a different position of said cassette depending on the size of cut sheets contained therein, and wherein said sheet size output means is a reed switch corresponding locationally to said magnet of said cassette and outputting a detection signal reflecting the size of the cut sheets in said cassette.

* * * * *